United States Patent [19]

Szajewski et al.

[11] Patent Number: 5,006,448

[45] Date of Patent: Apr. 9, 1991

[54] PHOTOGRAPHIC MATERIAL AND PROCESS

[75] Inventors: Richard P. Szajewski; Paul A. Burns; Jerrold N. Poslusny, all of Rochester; Norma B. Platt, Ontario; Timothy D. Norden, Rochester, all of N.Y.

[73] Assignee: Eastman Kodak Company, Rochester, N.Y.

[21] Appl. No.: 366,730

[22] Filed: Jun. 15, 1989

[51] Int. Cl.[5] ..... G03C 1/08; G03C 1/46

[52] U.S. Cl. ..... 430/505; 430/544; 430/957

[58] Field of Search ..... 430/544, 957, 505

[56] References Cited

U.S. PATENT DOCUMENTS 4,746,600 5/1988 Watanabe et al. ..... 430/505

4,791,049 12/1988 Kojima et al. ..... 430/544

*Primary Examiner*—Charles L. Bowers, Jr.

*Assistant Examiner*—Janet C. Baxter

*Attorney, Agent, or Firm*—Richard E. Knapp

[57] ABSTRACT

A photographic recording material is disclosed which contains a compound capable of releasing a development inhibitor moiety during photographic processing which enhances development inhibition and reduces interlayer interimage effects without adversely affecting photographic properties.

15 Claims, No Drawings

PHOTOGRAPHIC MATERIAL AND PROCESS

This invention relates to a photographic recording material comprising a compound capable of releasing a development inhibitor moiety during photographic processing to provide enhanced development inhibition and reduced interlayer interimage effects, without loss of desirable photographic properties.

Various compounds, particularly couplers, are known in the photographic art that are capable of releasing a development inhibitor moiety, such as a mercaptotetrazole moiety. For example, U.S. Pat. No. 4,248,962 describes compounds such as couplers that are capable of releasing a photographically useful group, such as a development inhibitor moiety, by means of an intramolecular nucleophilic displacement reaction. Such compounds provide advantageous imaging properties.

Other couplers that are capable of releasing a development inhibitor (DIR) moiety are also known. Such couplers are described in Belgian Patent 789,595; U.S. Pat. Nos. 4,049,455; 4,428,962., 4,095,984; 4,409,323; 3,227,554; 3,701,783; 3,615,506; 3,617,291; 3,379,529; 3,620,746., 3,384,657 and 3,733,201, as well as in "Development-Inhibitor-Releasing (DIR) Couplers in Color Photography", C. R. Barr, J. R. Thirtle and in P. W. Vittum, *Photographic Science and Engineering.* 13. 74 (1969).

European Patent Applications 169,458 and 272,573 and German Offenlegungsschriften 3,626,219, 3,636,824, 3,644,405 and 3,644,416 disclose photographic elements comprising monocyclic triazole development inhibitor moieties, several of which are substituted with thio alkyl moieties. The photographic elements of these applications are described as exhibiting large interimage effects.

A need has existed in color photographic silver halide materials to provide a combination of (i) enhanced development inhibition and (ii) lower interimage effects. Such properties are demonstrated by reduced development inhibition in adjacent photographic layers without (iii) reduced image acutance. This combination of enhanced photographic properties has not heretofore been provided by known development inhibitor releasing (DIR) couplers. This is demonstrated below by comparative data.

The present invention provides these improved properties through use of a photographic recording material comprising a support having thereon at least two light sensitive silver halide emulsion layers and a compound capable of releasing a development inhibitor which enables, upon exposure and processing, reduced interimage effects, which compound has the formula:

CAR—(TIME)n—INH—Q wherein:

CAR is a carrier moiety from which (TIME)n—INH—Q is released during development;

TIME is a timing group;

INH—Q together constitute a development inhibitor moiety with the proviso that INH does not comprise a monocyclic triazole moiety; and Q comprises from 1 to 4 thioether moieties, in each of which the sulfur atom is directly bonded to a saturated carbon atom but is not directly bonded to an INH heterocyclic ring;

n is 0, 1, or 2,

CAR can, for example, be a hydrazide moiety, as described in U.S. Pat. No. 4,684,604, or a hydroquinone moiety, as described in U.S. Pat. No. 3,379,529. However, CAR is preferably a coupler (COUP) moiety. The nature of the ballast group useful in conferring nondiffusibility is not critical to the development inhibitor releasing (DIR) compound. Typical ballast groups include long chain alkyl radicals linked directly or indirectly to the compound. Useful ballast groups generally have at least 8 carbon atoms, such as, for example, substituted or unsubstituted alkyl groups of 8 to 22 carbon atoms, amide radicals having 8 to 30 carbon atoms or keto radicals having 8 to 30 carbon atoms.

The CAR or coupler moiety can be ballasted with an oil-soluble or a fat-tail group. When the moiety is a coupler moiety it can be monomeric or it can form part of a dimeric, oligomeric or polymeric coupler. In the latter case more than one INH—Q moiety can be contained in the coupler. Alternatively, the INH—Q moiety can form part of a bis compound in which the TIME group can form part of the link between two coupler moieties.

In addition to the ballast group, either TIME or Q in the above formula may have groups or atoms attached thereto such as halogen, alkyl, aryl, alkoxy, aryloxy, nitro, amino, alkylamino, arylamino, amido, cyano, keto, carboalkoxy, carbamyl, sulfonyl, sulfonamide, sulfamyl or heterocyclic groups, one or more of which groups may also confer immobility to the DIR compound.

The INH part of the development inhibitor moiety INH—Q comprises a heterocyclic ring having from 5 or 6 atoms in a monocyclic ring or from 8 to 10 atoms in a bicyclic ring system. The ring atoms include one or more hetero atoms of nitrogen, sulfur, and oxygen. Such rings include, but are not limited to oxazoles, thiazoles, diazoles, oxadiazoles, thiadiazoles, oxathiazoles, thiatriazoles, benzotriazoles, tetrazoles, benzimidazoles, indazoles, isoindazoles mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxadiazoles, mercaptothiadiazoles, and benzisodiazoles . As noted above, INH does not comprise a monocyclic triazole ring.

An illustrative compound where CAR is a coupler moiety is represented by the formula:

$$\text{COUP—(TIME)}_n\text{—INH—Q}$$

wherein: COUP is a coupler moiety, and TIME, n and INH—Q are as defined above.

When CAR is a coupler moiety and TIME is bonded to the coupling position thereof, TIME, along with the attached INH—Q moiety, is released from CAR upon exposure and processing of the photographic recording material. The controlled release of INH—Q is advantageous for particular photographic applications.

COUP can be any moiety that will react with oxidized color developing agent to cleave the bond between TIME and COUP. Included are coupler moieties employed as conventional color-formers that yield colorless products as well as coupler moieties that yield colored products on reaction with oxidized color developing agents. Both types of coupler moieties are known to those skilled in the photographic art.

It will be appreciated that, depending upon the particular coupler moiety, the particular color developing agent and the type of processing employed, the reaction product of the coupler moiety and the oxidized color developing agent can be: (1) colored and nondiffusible, in which case it will remain in the location where it is formed; (2) colored an diffusible, in which case it may be removed during processing from the location where it is formed or allowed to migrate to a different location; or (3) colorless and either diffusible or nondiffusible, in which cases it will not contribute to image density. In cases (2) and (3) the reaction product may be initially colored and/or nondiffusible but converted to colorless and/or diffusible products during the course of processing.

The Q moiety may be unchanged as the result of exposure to photographic processing solution However, Q may change in structure and effect in the manner disclosed in U.K. Patent No. 2,099,167, European Patent Application 167,168, Japanese Kokai 205150/83 or U.S. Pat. No. 4,782,012 as the result of photographic processing.

Q, represents 1 to 4 monovalent or a divalent groups, which can be alkyl, alkylene, aryl, arylene, alkoxy, aryloxy, alkylthio, arylthio, alkylamino, arylamino, carbalkoxy or heterocyclic so long as each group comprises from 1 to 4 thioether moieties in each of which the sulfur atom is directly bonded to a saturated carbon atom but is not directly bonded to an INH heterocyclic ring. These groups can be substituted with one or more halogen, nitro, amino, cyano, amido, carbamoyl, sulfonyl, sulfonamido or sulfamoyl substituents. In addition to thioether groups, Q may contain non-thioether sulfur atoms directly bonded to isolated groups C=0, C=S, C=N, or to C=N— which is not incorporated in a heterocyclic ring.

In typical Q groups the thioether sulfur atom can be bonded to $-(CH_2)_m-$, where m is 1 to 12,

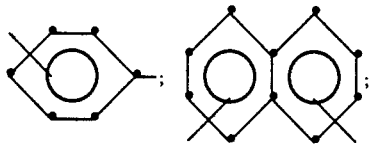

$-CH_3$; $-CH_2CH_3$; $-C_3H_7$; $-C_4H_9$; $-C_4H_9$-t; $-C_5H_{11}$;

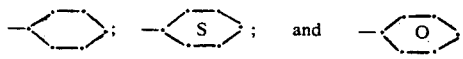

The development inhibitor moiety, INH—Q, preferably comprises a 1,2,3,4-tetrazole moiety having the formula:

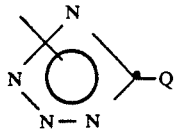

wherein, as noted above, Q comprises from 1 to 4 thioether moieties in each of which the sulfur atom is directly bonded to a saturated carbon atom but is not directly bonded to the tetrazole INH ring.

Alternatively, the development inhibitor moiety INH—Q can comprise a benzotriazole group which can have the structure:

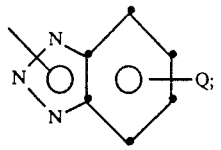

or a 5-mercapto-1,2,3,4-tetrazole moiety which can have the structure:

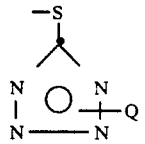

wherein Q is as defined above.

When TIME is joined to a coupler it can be bonded at any of the positions from which groups are released from couplers by reaction with oxidized color developing agent. Preferably, TIME is attached at the coupling position of the coupler moiety so that upon reaction of the coupler with oxidized color developing agent TIME, with attached groups, will be released from COUP.

TIME can also be in a non coupling position of the coupler moiety from which it can be displaced as a result of reaction of the coupler with oxidized color developing agent. In the case where TIME is in a non-coupling position of COUP, other groups can be in the coupling position, including conventional coupling off groups. Also, the same or different inhibitor moieties from those described in this invention, can be used. Alternatively, COUP can have a timing and an inhibitor group in each of a coupling position and a non-coupling position. Accordingly, compounds useful in this invention can release more than one mole of inhibitor per mole of coupler.

TIME can be any organic group which will serve to connect CAR to the inhibitor moiety and which, after cleavage from CAR, will in turn be cleaved from the inhibitor moiety. This cleavage is preferably by an intramolecular nucleophilic displacement reaction of the type described in, for example, U.S. Pat. No. 4,248,962, or by electron transfer along a conjugated chain as described in, for example, U.S. Pat. No. 4,409,323.

As used herein, the term "intramolecular nucleophilic displacement reaction" refers to a reaction in which a nucleophilic center of a compound reacts directly, or indirectly through an intervening molecule, at another site on the compound, which is an electrophilic center, to effect displacement of a group or atom attached to the electrophilic center. Such compounds have both a nucleophilic group and an electrophilic group spatially related by the configuration of the molecule to promote reactive proximity. Preferably the nucleophilic group and the electrophilic group are located in the compound so that a cyclic organic ring, or a transient cyclic organic ring, can be easily formed by an intramolecular reaction involving the nucleophilic center and the electrophilic center.

Useful timing groups are represented by the structure:

$-(Nu-LINK)-E$ wherein:

Nu is a nucleophilic group attached to a position on CAR from which it will be displaced upon reaction of CAR with oxidized color developing agent;

E is an electrophilic group attached to an inhibitor moiety as described and is displaceable therefrom by Nu after Nu is displaced from CAR; and LINK is a linking group for spatially relating Nu and E, upon displacement of Nu from CAR, to undergo an intramolecular nucleophilic displacement reaction with the formation of a 3- to 7-membered ring and thereby release the INH—Q moiety.

A nucleophilic group (Nu) is defined herein as a group of atoms one of which is electron rich. Such an atom is referred to as a nucleophilic center. An electrophilic group (E) is defined herein as a group of atoms one of which is electron deficient. Such atom is referred to as an electrophilic center.

Thus, in photographically useful compounds as described herein, the timing group can contain a nucleophilic group and an electrophilic group which groups are spatially related with respect to one another by a linking group so that upon release from CA the nucleophilic center and the electrophilic center will react to affect displacement of the INH—Q inhibitor moiety from the timing group. The nucleophilic center should be prevented from reacting with the electrophilic center until release from the CAR moiety and the electrophilic center should be resistant to external attack such as by hydrolysis. Premature reaction can be prevented by attaching the CAR moiety to the timing group at the nucleophilic center or an atom in conjunction with a nucleophilic center, so that cleavage of the timing group and the inhibitor moiety from CAR unblocks the nucleophilic center and permits it to react with the electrophilic center, or by positioning the nucleophilic group and the electrophilic group so that they are prevented from coming into reactive proximity until release. The timing group can contain additional substituents, such as additional photographically useful groups (PUGs), or precursors thereof, which may remain attached to the timing group or be released.

It will be appreciated that in the timing group, for an intramolecular reaction to occur between the nucleophilic group and the electrophilic group, the groups should be spatially related after cleavage from CAR, so that they can react with one another. Preferably, the nucleophilic group and the electrophilic group are spatially related within the timing group so that the intramolecular nucleophilic displacement reaction involves the formation of a 3- to 7-membered ring, most preferably a 5- or 6-membered ring.

It will be further appreciated that for an intramolecular reaction to occur in the aqueous alkaline environment encountered during photographic processing, the thermodynamics should be such and the groups be so selected that an overall free energy decrease results upon ring closure, forming the bond between the nucleophilic group and the electrophilic group, and breaking the bond between the electrophilic group and the INH—Q group. Not all possible combinations of nucleophilic group, linking group, and electrophilic group will yield a thermodynamic relationship favorable to breaking of the bond between the electrophilic group and the inhibitor moiety. However, it is within the skill of the art to select appropriate combinations taking the above energy relationships into account.

Representative Nu groups contain electron rich oxygen, sulfur and nitrogen atoms. Representative E groups contain electron deficient carbonyl, thiocarbonyl, phosphonyl and thiophosphonyl moieties. Other useful Nu and E groups will be apparent to those skilled in the art.

In the following listings of representative Nu and E groups, the groups are oriented so that the lefthand bond of Nu is joined to CAR and the righthand bond of Nu is joined to LINK, while the lefthand bond of E is joined to LINK and the righthand bond of E is joined to INH.

Representative Nu groups include:

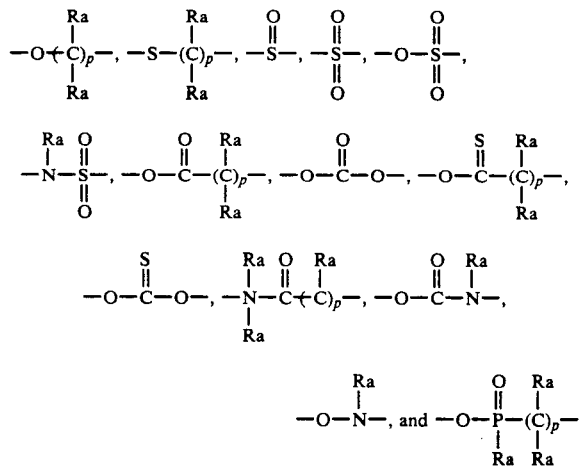

where each Ra is independently hydrogen, alkyl, such as alkyl of 1 to 20 carbon atoms including substituted alkyl such as methyl, ethyl, propyl, hexyl, decyl, pentadecyl, octadecyl, carboxyethyl, hydroxypropyl, sulfonamidobutyl and the like, or aryl, such as aryl of 6 to 20 carbon atoms including substituted aryl such as phenyl, naphthyl, benzyl, tolyl, t-butylphenyl, carboxyphenyl, chlorophenyl, hydroxyphenyl and the like, and p is an integer from 0 to 4 such that the ring formed by Nu LINK and E upon nucleophilic attack of Nu upon the electrophilic center in E contains 3 to 7 ring atoms. Preferably Ra is hydrogen, alkyl of 1 to 4 carbon atoms or aryl of 6 to 10 carbon atoms.

Representative E groups include:

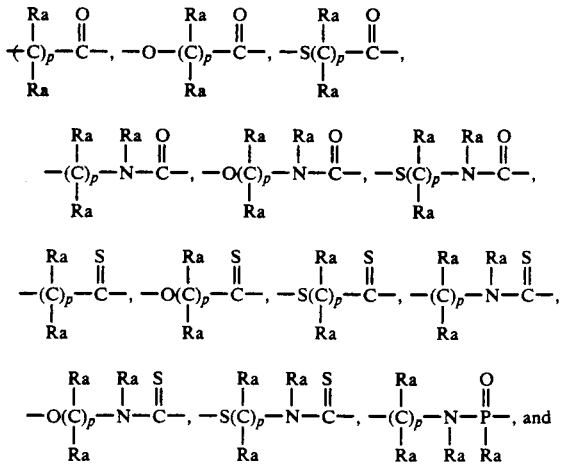

-continued

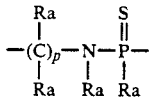

where Ra and p are as defined above.

E is preferably an electrophilic group selected from the group consisting of

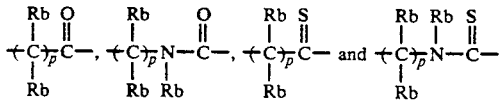

wherein each Rb is independently hydrogen, alkyl, such as alkyl containing 1 to 20 carbon atoms, preferably alkyl containing 1 to 4 carbon atoms, or aryl, such as aryl containing 6 to 20 carbon atoms, preferably aryl containing 6 to 10 carbon atoms; and p is 0 to 4, such that the ring formed upon reaction of the nucleophilic center in Nu with the electrophilic center in E contains 5 or 6 members.

The linking group can be an acyclic group such as alkylene, for example methylene, ethylene or propylene, or a cyclic group such as an aromatic group, such as phenylene or naphthylene, or a heterocyclic group, such as furan, thiophene, pyridine, quinoline or benzoxazine. Preferably LINK is alkylene or arylene. The groups Nu and E are attached to LINK to provide, upon release of Nu from CAR, favorable spatial relationship for nucleophilic attack of the nucleophilic center in Nu on the electrophilic center in E. When LINK is a cyclic group, Nu and E can be attached to the same or adjacent rings. Aromatic groups in which Nu and E are attached to adjacent ring positions are particularly preferred LINK groups.

TIME can be unsubstituted or substituted. The substituents can be those which will modify the rate of reaction, diffusion, or displacement, such as halogen, including fluoro, chloro, bromo, or iodo, nitro, alkyl of 1 to 20 carbon atoms, acyl, such as carboxy, carboxyalkyl, alkoxycarbonyl, alkoxycarbonamido, sulfoalkyl, alkanesulfonamido, and alkyl sulfonyl, solubilizing groups, ballast groups and the like, or they can be substituents which are separately useful in the photographic element such as a stabilizer, an antifoggant, a dye (such as a filter dye or a solubilized masking dye) and the like. For example, solubilizing groups will increase the rate of diffusion; ballast groups will decrease the rate of diffusion; electron withdrawing groups will decrease the rate of displacement of the INH group.

As used herein the term "electron transfer down a conjugated chain" is understood to refer to transfer of an electron along a chain of atoms in which alternate single bonds and double bonds occur. A conjugated chain is understood to have the same meaning as commonly used in organic chemistry. Electron transfer down a conjugated chain is as described in, for example, U.S. Pat. No. 4,409,323.

For convenience herein when the timing group is of the type described in U.S. Pat. No. 4,409,323, such group can be described as a "quinone methide timing group". Examples of useful couplers comprising a quinone methide timing group are as follows:

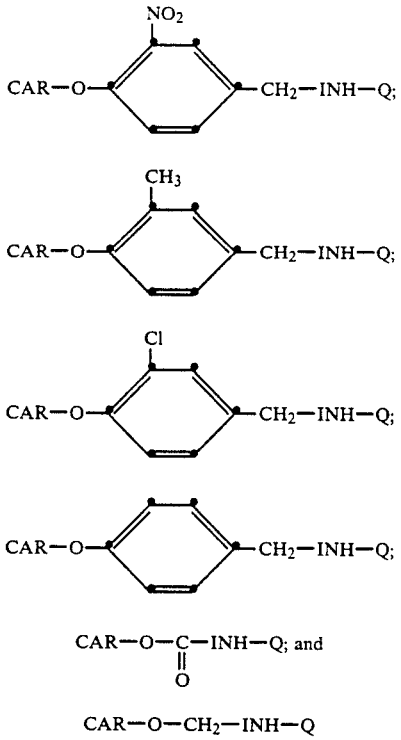

wherein CAR and INN—Q are as described above.

Other useful timing groups are described in U.S. Pat. Nos. 4,737,451; 4,546,073; 4,564,587; 4,618,571; 4,698,297; and European published Patent Applications 167,168 and 255,085.

Typical examples of development inhibitor moieties represented by —INH—Q include the following:

Compound

I-1

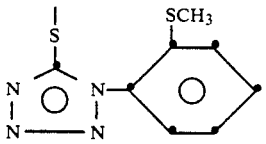

I-2

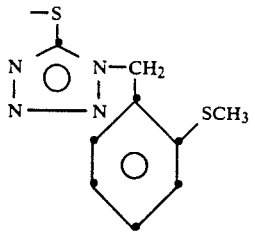

I-3

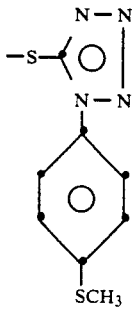

-continued
I-4
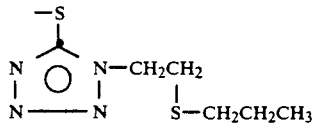
I-5
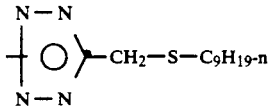
I-6
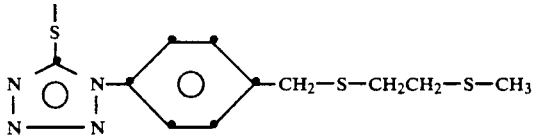
I-7
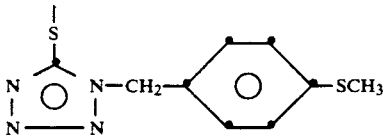
I-8
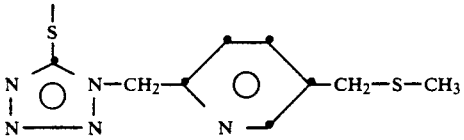
I-9
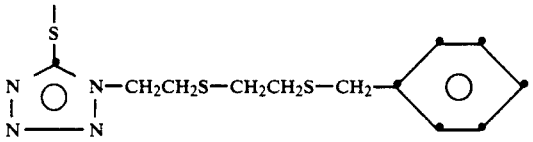
I-10
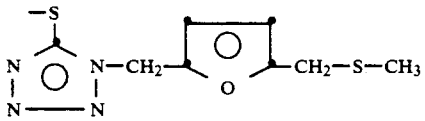
I-11
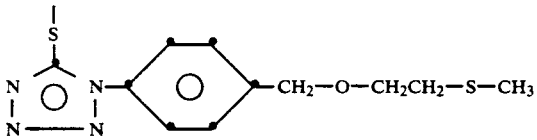
I-12
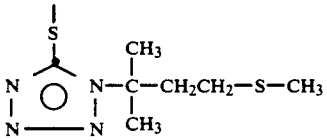
I-13
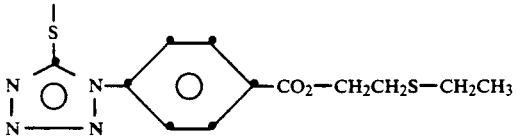
-continued
I-14
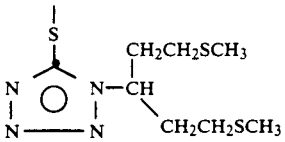
I-15
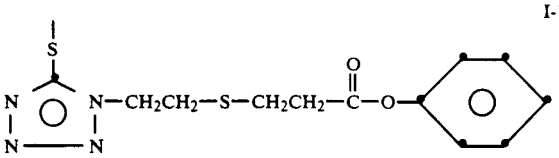
I-16
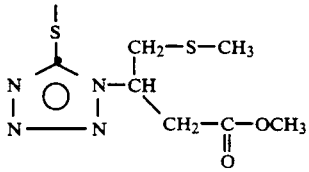
I-17
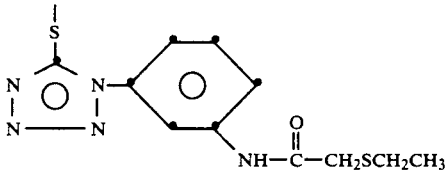
I-18
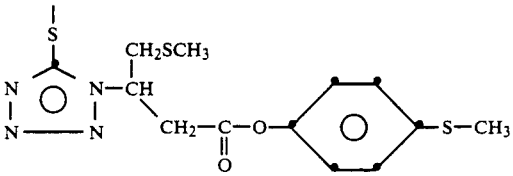
I-19
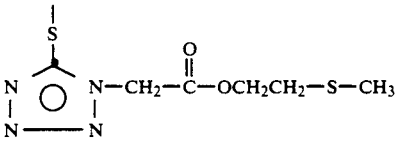
I-20
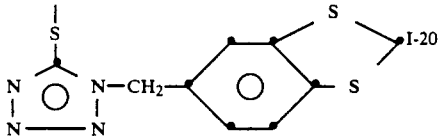
I-21
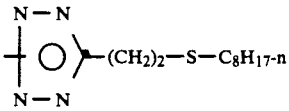
I-22
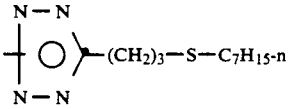
I-23
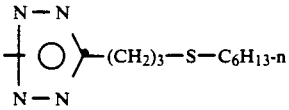

-continued
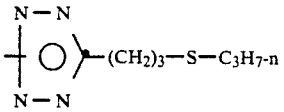
I-24
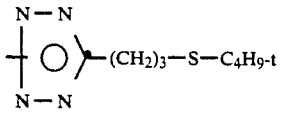
I-25
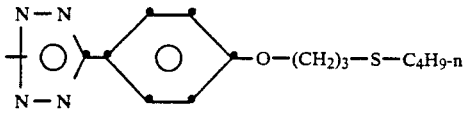
I-26
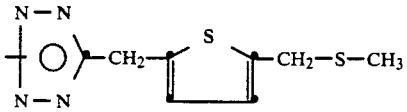
I-27
In the following examples of development inhibitor moieties of this invention Y and Z are:
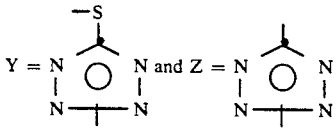
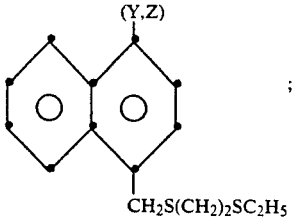
;
I-28, I-29
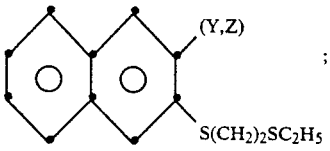
;
I-30, I-31
(Y,Z)—$CH_2CO_2(CH_2)_3$—$SCH_3$ ;
I-32, I-33
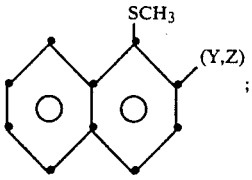
;
I-34, I-35
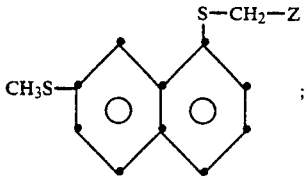
;
I-36
Z—N[$(CH_2)_2$S—$C_4H_9$-n)]$_2$;
I-37
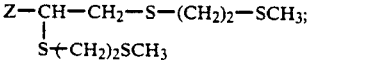
I-38
-continued
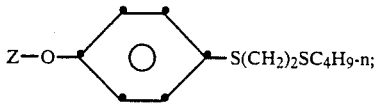
I-39
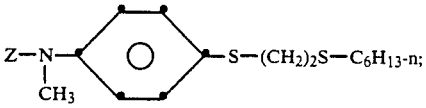
I-40
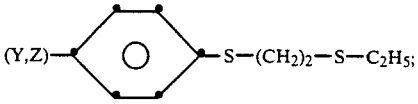
I-41, I-42
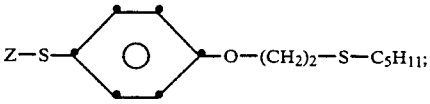
I-43
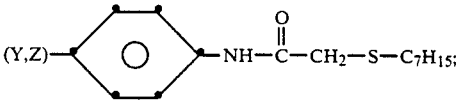
I-44, I-45
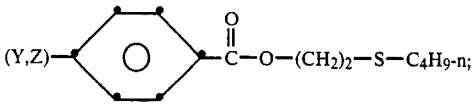
I-46, I-47
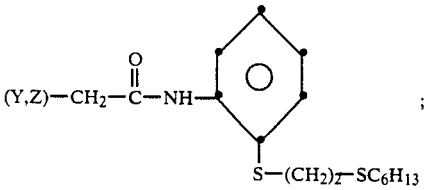
;
I-48, I-49
(Y,Z)—$(CH_2)_6$S—$C_4H_9$;
I-50, I-51
Z—$CH_2$—S$(CH_2)_2$S—$(CH_2)_2$S—$C_4H_9$;
I-52
Z—CH[S—$(CH_2)_2$—S—$C_2H_5$]$_2$;
I-53
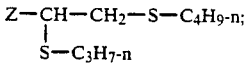
I-54
(Y,Z→C$(CH_3)_2$—$CH_2$—S—$(CH_2)_2$S—$C_2H_5$;
I-55, I-56
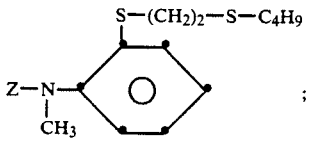
;
I-57
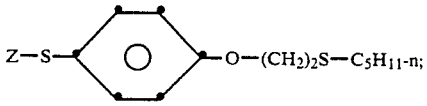
I-58
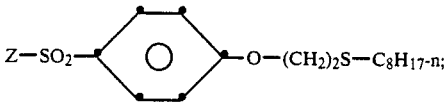
I-59

-continued
I-60
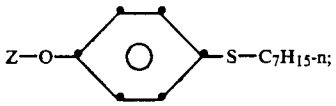
I-61, I-62
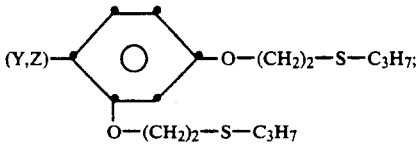
I-63, I-64
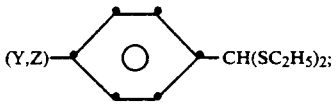
I-65, I-66
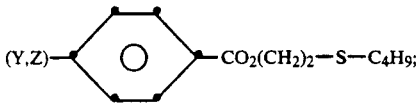
I-67, I-68
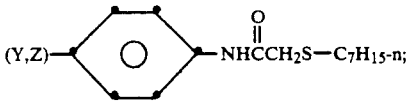
I-69
$Z-SO_2-(CH_2)_2S-C_{12}H_{25}$-n;
I-70
$Z-SO_2N[(CH_2)_2S-C_4H_9]_2$;
I-71, I-72
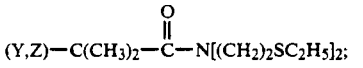
I-73, I-74
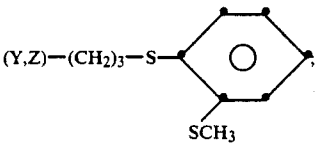
I-75, I-76
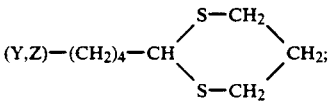
I-77, I-78
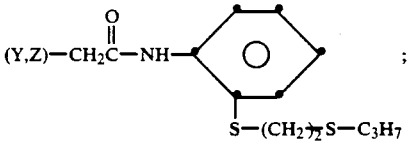
I-79, I-80
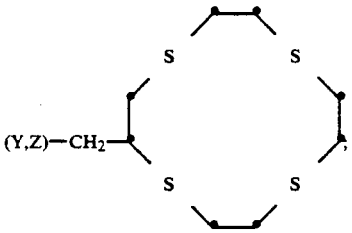
I-81
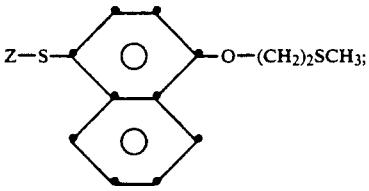
-continued
I-82, I-83
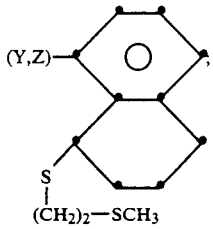
I-84
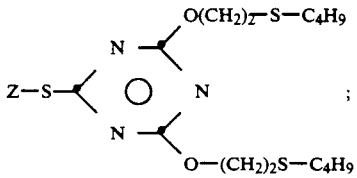
I-85, I-86
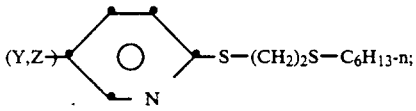
I-87, I-88
$(Y,Z)-CH_2CH_2SCH_3$;
I-89, I-90
$(Y,Z)-C(CH_3)_2-CH_2SCH_3$;
I-91, I-92
$(Y,Z)-CH_2CO_2-CH_2CH_2SCH_3$;
I-93
$Z-S-CH_2-P(=O)(OCH_2CH_2-S-C_4H_9)_2$;
I-94
$Z-CH_2-P(=O)(OCH_2CH_2S-CH_3)_2$;
I-95, I-96
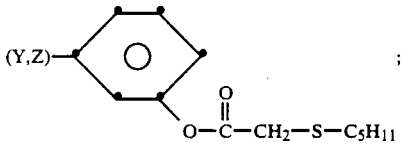
I-97
$Z-CH_2-S-CH_2-C(=O)-OCH_2CCl_3$;
I-98, I-99
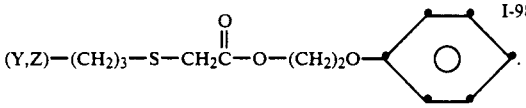
Additional examples of development inhibitor moieties of this invention include:
I-100
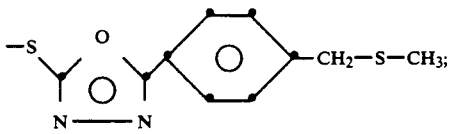
I-101
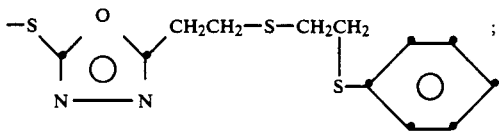
I-102
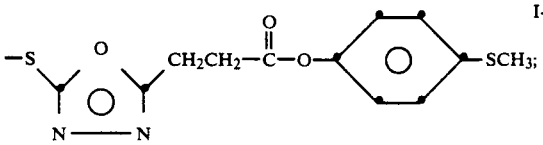

-continued
I-103
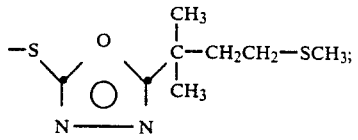
I-104
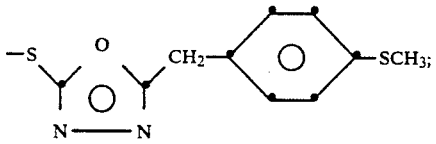
I-105
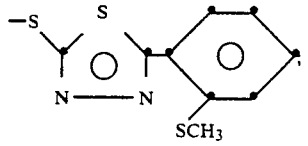
I-106
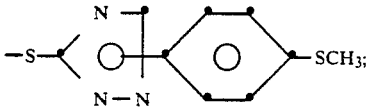
I-107
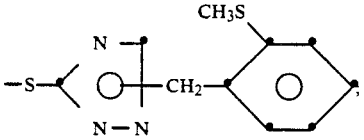
I-108
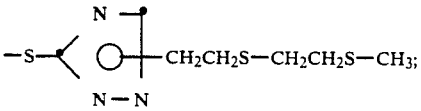
I-109
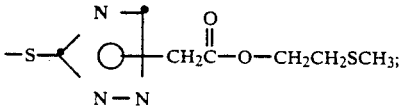
I-110
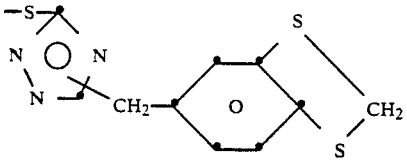
I-111
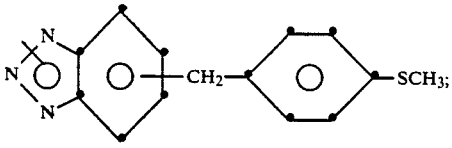
I-112
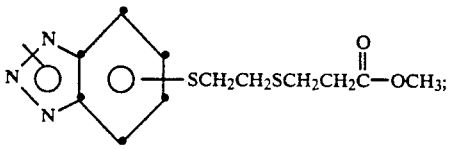
I-113
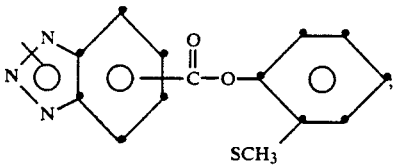
-continued
I-114
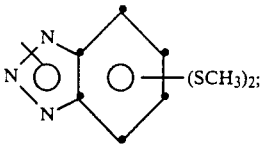
I-115
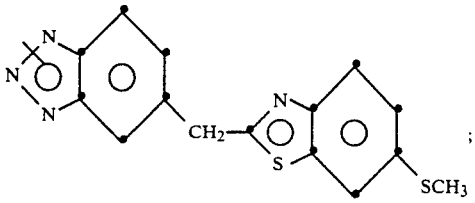
I-116
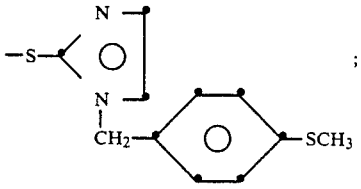
I-117
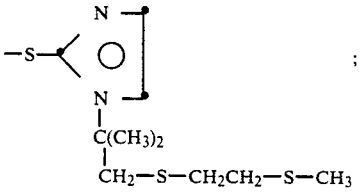
I-118
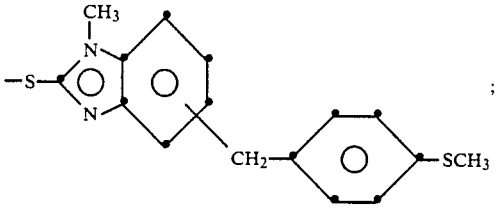
I-119
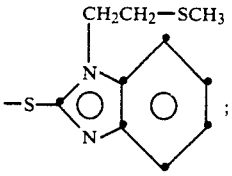
I-120
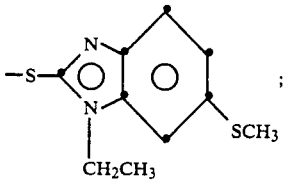
I-121
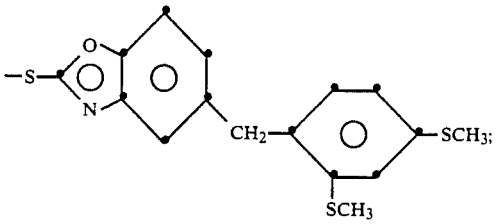

-continued

I-122

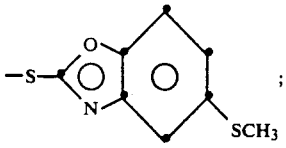

;

I-123

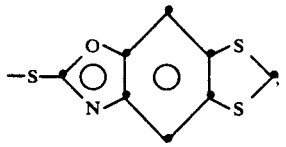

;

I-124

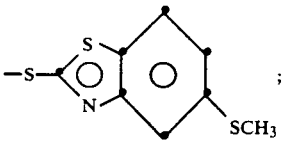

;

I-125

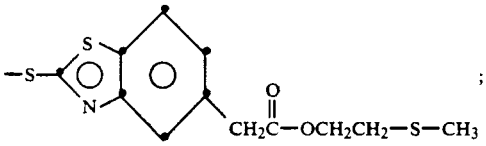

;

I-126

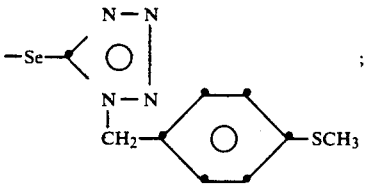

;

I-127

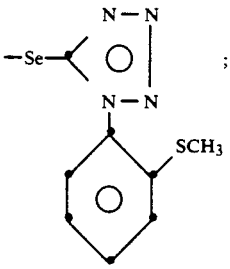

;

I-128

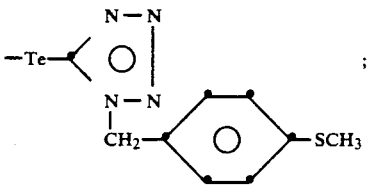

;

I-129

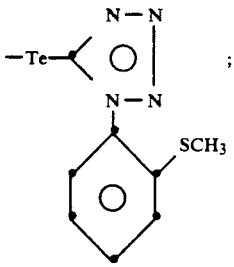

;

-continued

I-130

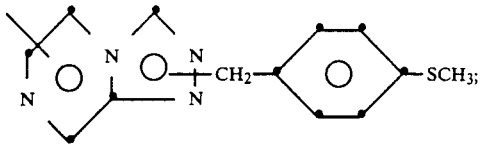

I-131

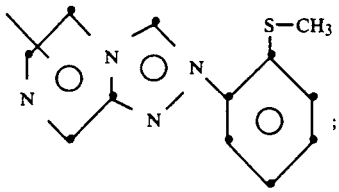

;

I-132

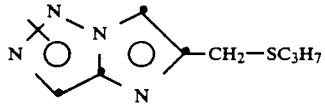

I-133

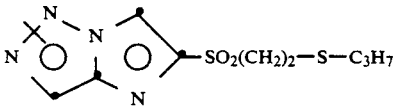

I-134 $Z-(CH_2)_3S(CH_2)_2SC_2H_5$;

I-135 $Z-(CH_2)_3S(CH_2)_2S-C_4H_9$-n;

I-136

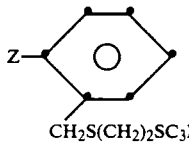

I-137

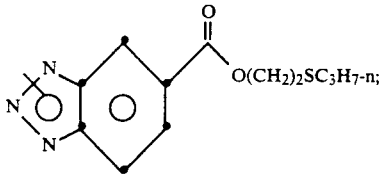

I-138

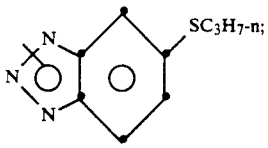

I-139

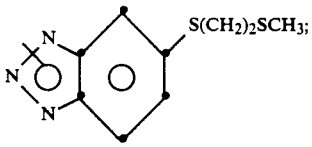

I-140

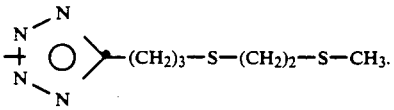

The development inhibitor moieties of the type described above can be prepared by methods already known in the art. One method, useful in the preparation of development inhibitor moiety I-1 is described in Synthesis Example A below.

For example, procedures useful in preparing 5-substituted tetrazoles from alkyl or aryl nitriles are described in E. Lieber and T. Enkoji, *J. Org. Chem.* Soc., 80, 3908–3911 (1958), and P. R. Berstein and E. P. Vacek, *Synthesis,* 1133–1134 (1987). Synthesis Example A through D illustrate the preparation of four typical development inhibitor moieties. All compounds in these procedures gave satisfactory 300 MHz NMR spectra.

SYNTHESIS EXAMPLE A

Preparation of Development Inhibitor Moiety I -1

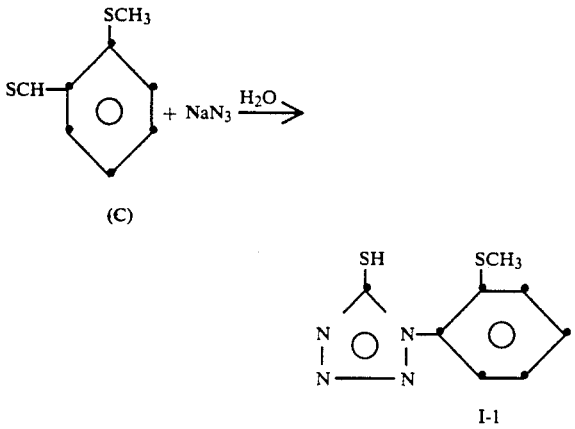

A mixture comprising 20.0 g (0.110 mmol) of C, 24.3 g (0.220 mol) of $NaN_3$ and 200 ml of water was heated under reflux for 6 hours, cooled, washed with diethyl ether and then acidified with conc (37%) HCl to pH 1. The mixture was extracted with diethyl ether and the ether extract was washed with water and saturated NaCl solution. The resulting liquid was dried over $MgSO_4$ and concentrated to yield 20.7 g (84%) of a white solid Compound I-1, mp 127.5°–128° C.

SYNTHESIS EXAMPLE B

Preparation of Development Inhibitor Moiety I-134

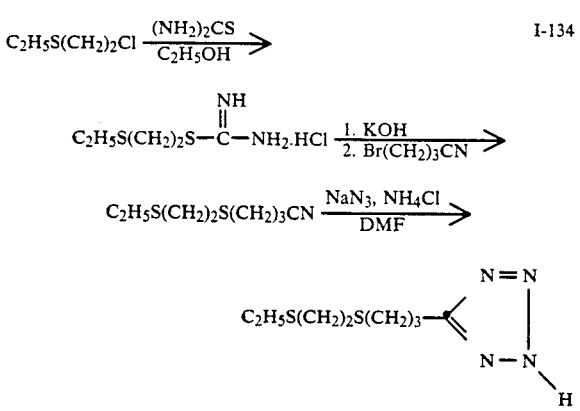

A solution of 12.2 g (0.161 mol) thiourea and 20.0 g (0.161 mol) 2 chloroethyl ethyl sulfide in 75 ml ethanol was refluxed for 1.5 hours. The solution was evaporated and the resulting oil triturated with ether to obtain 32.7 g S alkylthioronium salt. Potassium hydroxide (20.2 g, 0.306 mol) was added to 30.0 g (0.15 mol) S-alkylthiouronium salt in 150 ml ethanol. The slurry was refluxed for 2 hours. The slurry was cooled to room temperature and 4 bromobutyronitrile (21.5 g, 0.145 mol) added all at once, and the slurry was stirred for 0.5 hours. The slurry was filtered and the salts washed with ethanol. The filtrate was evaporated and the resulting oil dissolved in 250 ml ethyl acetate. The solution was washed with 15 ml 4N NHCl and filtered to remove some insoluble material. The filtrate was washed with 10 ml 6N HCl and then with 25 ml brine; it was then dried over $MgSO_4$, filtered, and evaporated to give 28 g 4-(2-ethylthioethylthio)-butyronitrile as a pale yellow oil. A slurry of the nitrile (25.0 g, 0.132 mol), $NaN_3$ (9.4 g, 0.145 mol), $NH_4Cl$ (7.7 g, 0.145 mol), and aniline hydrochloride (1.7 g, 13 mmol) in 100 ml dimethylformamide (DMF) was stirred and heated at 100° C. under nitrogen for 42 hours. The slurry was evaporated to remove the DMF, and 75 ml water added to the residue. The resulting brown oil was extracted with 400 ml ethyl acetate. The solution was washed with 20 ml water and 25 ml brine. The light orange solution was dried over $MgSO_4$, treated with 7.5 g charcoal, and filtered. Evaporation of the pale yellow filtrate gave 34.5 g yellow oil. The oil was chromatographed through 2 liters silica gel using 90:5:5 dichloromethane: tetrahydrofuran: methanol. Trituration of the resulting oil with diethyl ether:ligroin gave 16.3 g colorless solid. Recrystallization from ether gave 14.9 g (48.5%) of Compound I-134, mp 64°–66° C.

| | Analytical Results | |
|---|---|---|
| | Calc. | Found |
| C | 41.4 | 41.6 |
| H | 6.9 | 6.9 |
| N | 24.1 | 24.6 |
| S | 27.6 | 27.6 |

SYNTHESIS EXAMPLE C

Preparation of Development Inhibitor Moiety I-26

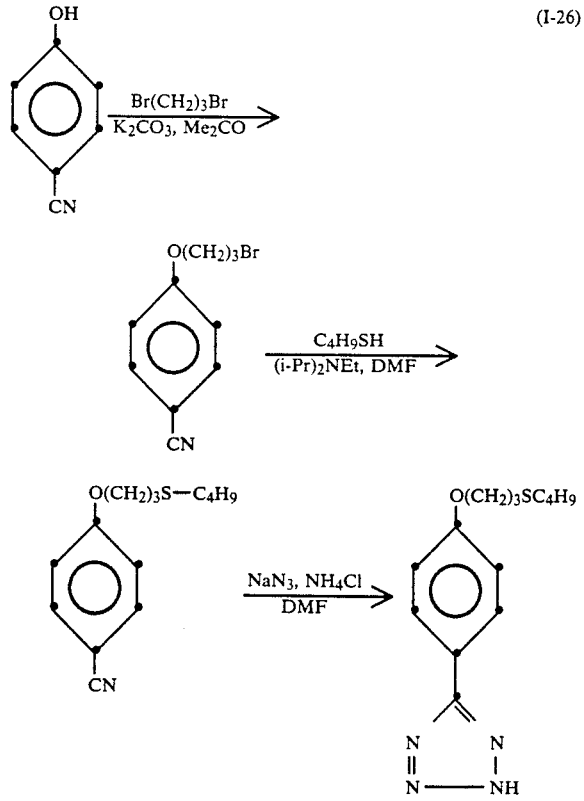

A stirred slurry of 4-hydroxybenzonitrile (50.0 g, 0.42 mol), 1,3-dibromopropane (678 g, 3.36 mol), potassium carbonate (87 g, 0.63 mol), and 18 crown-6 (2.5 g) in 1 l acetone was refluxed for 4 hours; 600 ml acetone was distilled off, and the residue poured into 2 liter water. The aqueous layer was extracted with 2×250 ml dichloromethane. The organic layers were combined and then washed with 750 ml water, dried over $MgSO_4$, filtered, and evaporated to remove the solvent. The excess 1,3-dibromopropane was removed on the rotary evaporator at 100° C. to recover 518 g. The residue (115 g) was dissolved in 250 ml 1:1 ligroin: dichloromethane and the solution filtered to obtain 4.5 g 1,3-(4'-cyanophenoxy)propane, mp 166°-167° C. The filtrate was evaporated. The resulting oil chromatographed through 3 liters silica gel using 55:45 ligroin: dichloromethane to give 89.3 g (89%) 4'-(3-bromopropoxy)benzonitrile. A solution of the nitrile (24 g, 0.10 mol), butanethiol (10.8 g, 0.12 mol), and N,N-diisopropylethylamine (16 g, 0.125 mol) in 75 ml DMF was heated on the steam bath for 3 hours. The solution was poured into 600 ml ice/water, and the resulting oil extracted with 2×200 ml diethyl ether. The ether solution was extracted with 500 ml 2.5% NaOH, 100 ml 3N HCl, and brine. The solution was dried over $MgSO_4$, filtered, and evaporated to give 25 g light orange oil. The oil was chromatographed through 3 liters silica gel using 9:1 dichloromethane:ethyl acetate to give 16.9 g (68%) 4'-(3-butylthiopropoxy)benzonitrile, a light yellow oil. A slurry of the nitrile (16.0 g, 64.2 mmol), $NaN_3$ (4.6 g, 70.6 mmol), $NH_4Cl$ (3.75 g, 70.6 mmol), and aniline hydrochloride (0.8 g, 7 mmol) in 75 ml DMF was stirred and heated at 105° C. for 18 hours. The DMF was removed on a rotary evaporator, and 75 ml water and 5 ml HCl added to the residue. The solid was filtered and washed with water to obtain, on drying, 16.4 g light tan solid. Recrystallization from acetonitrile gave 14.5 g off-white solid; further recrystallization from methanol gave 12.5 g (66.5%) Compound I-26, mp 156°-157° C.

| | Analytical Results | |
|---|---|---|
| | Calc. | Found |
| C | 57.5 | 57.4 |
| H | 6.9 | 6.7 |
| N | 19.2 | 19.3 |
| S | 11.0 | 10.7 |

SYNTHESIS EXAMPLE D

Preparation of Development Inhibitor Moiety I-139

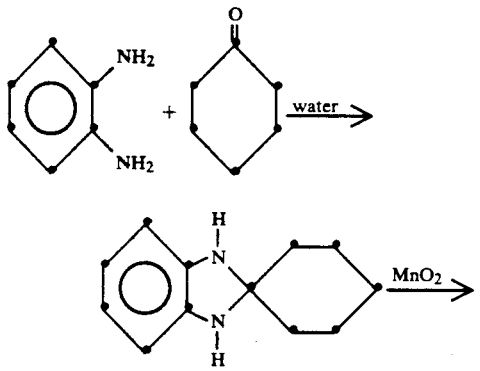

(I-139)

-continued

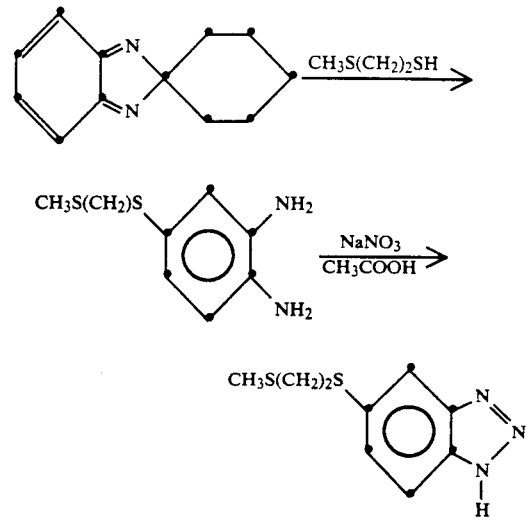

In a procedure similar to that described by H. Suschitszky in *Croatica Chemica Acta*, 59, 57-77 (1986), o-phenylenediamine (108 g, 1.0 mol) was dissolved in 1 liter hot water on a steam bath. With vigorous stirring and heating, cyclohexanone (98 g, 1.0 mol) was added in a rapid stream. After 5 minutes a brown gum formed; after 15 minutes a solid resulted. Stirring was continued for a total of 35 minutes. The slurry was cooled in an ice bath and then filtered to yield 112 g (59.5%) 1,3-dihydrobenzimidazole-2-spirocyclohexane. To a stirred solution of this compound (50 g, 0.266 mol) in 1 liter dichloromethane chloride was added, in several portions, 100 g $MnO_2$. The resulting slurry was stirred vigorously for 30 minutes and filtered. The solids were washed with dichloromethane and the filtrate evaporated to obtain an oil. The oil was dissolved in 200 ml, ligroin, and the solution cooled to −10° C. The resulting solid was filtered to yield 46 g (93%) 2H-benzimidazole-2 spirocyclohexane. A solution of 2 chloroethyl methyl sulfide (19.8 g, 0.20 mol) and thiourea (15.2 g, 0.20 mol) in 50 ml absolute alcohol was refluxed for 6 hours. To this was added a solution of KOH (22.4 g, 0.40 mol) in 100 ml methanol, and the resulting slurry refluxed for 45 minutes. After cooling to 30° , 37.2 g (0.20 mol) of freshly prepared 2H-benzimidazole-2-spirocyclohexane was added in portions. The mixture was stirred at room temperature for 10 minutes and then at reflux for 2 minutes. After cooling, the mixture was evaporated to a thick slurry; 100 ml dichloromethane was added and the mixture evaporated. This was repeated and the residue treated with 100 ml water and 200 ml dichloromethane. The organic layer was separated, washed with water, dried over $MgSO_4$, filtered, and evaporated. The residue was chromatographed through silica gel using an increasingly polar mixture of dichloromethane and acetonitrile. Product fractions were combined and evaporated to give 7.0 g 5'-(2-methylthioethylthio) 1',2'-phenylenediamine. A stirred solution of the phenylenediamine (5.0 g, 0.027 mol) in 50 ml acetic acid was treated with sodium nitrite (2.6 g, 0.037 mol), in 5 ml water, over 30 seconds at room temperature. The mixture was stirred for 15 minutes and then evaporated. The residue was treated with 50 ml water and 50 ml dichloromethane. The organic layer was dried over $MgSO_4$, filtered, and evaporated. Solid was chromatographed through silica gel using an increasingly polar mixture of dichloromethane chloride and acetone. The isolated product was recrystallized from ethyl acetate to yield 3.2 g (62%) 6'-(2-methyl thioethylthio)benzotriazole, I-139.

Compounds which contain releasable development inhibitor moieties suitable for use in accordance with this invention can be prepared by first synthesizing the inhibitor fragment and then attaching it to the carrier or to a linking or timing group by well-known methods.

Synthesis Examples E through H, described below, are typical preparations of development inhibitor releasing (DIR) compounds useful in this invention:

SYNTHESIS EXAMPLE E

Preparation Of Compound No. D-1

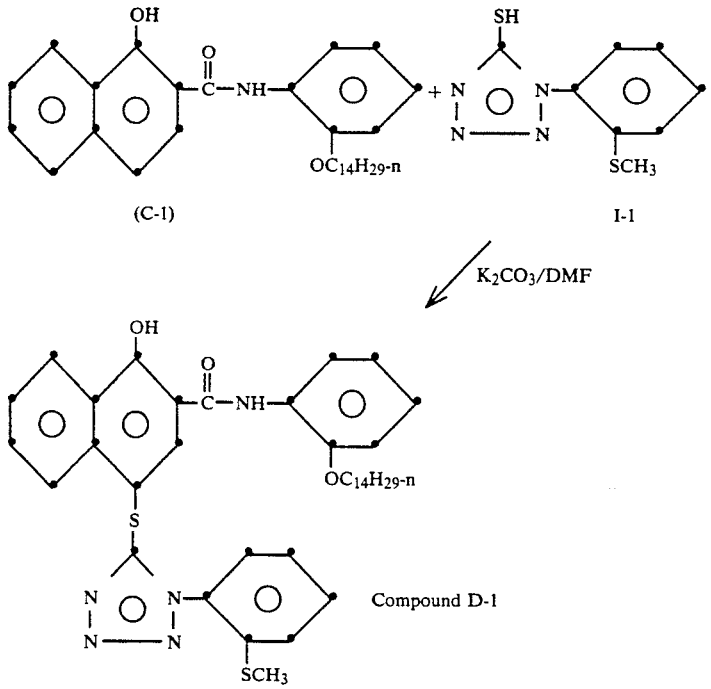

A combination of 26.8 g of C-1 (44.6 mmol, MW 601), 10.0 g of I-1 (44.6 mmol, MW 224), 6.2 g of $K_2CO_3$ (anhydrous, 44.6 mmol) and 250 ml of dry N,N-dimethylformamide (DMF) in 500 ml 3-neck round bottom flask with mechanical stirrer and condenser attached was heated on a steam bath for 6 hours. The reaction mixture was then cooled overnight to room temperature. Nitrogen gas was flowed down the condenser to pressurize the system after which the mixture was poured into 500 ml water. Acidification was accomplished with conc. (37%) HCl to pH 1. The solution yielded a sticky, dark blue material which was dissolved in 300 ml of dichloromethane. This solution was transferred to a separatory funnel and extracted with 300 ml of additional dichloromethane. The extractions were combined and washed with 300 ml $H_2O$ and 150 ml of saturated NaCl solution. The resulting product was dried with $MgSO_4$ and concentrated on a rotary evaporator. Recrystallization was twice effected from a 50/50 hexane/ethylacetate solution. The yield of Compound D-1 was 8.8 g (28%) melting at 116.5°–117° C.

| | Analytical Results | |
|---|---|---|
| | Calc. | Found |
| C | 67.1 | 67.1 |
| H | 6.8 | 7.0 |
| N | 10.0 | 9.9 |
| S | 9.2 | 9.2 |

SYNTHESIS EXAMPLE F

Preparation of Compound D-2

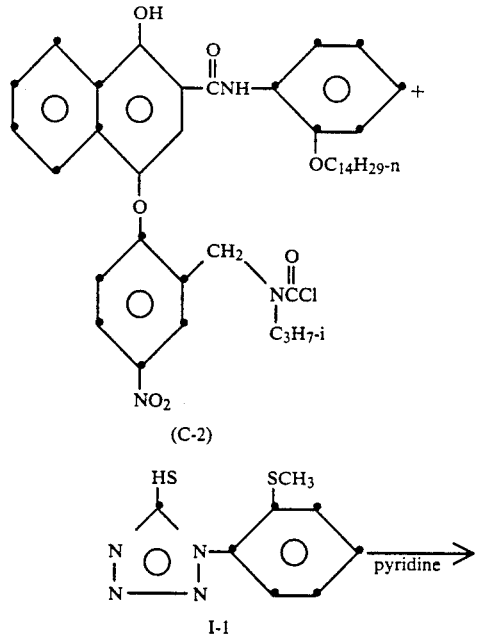

-continued

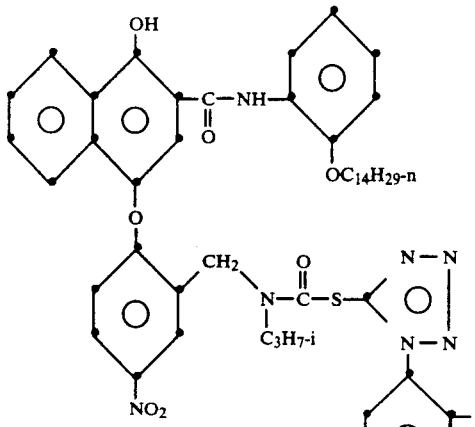

Compound D-2 triturated several times in isopropyl alcohol, recovered and dried to yield 14 g of Compound D-2 having a melting point of 113°-115° C.

| | Analytical Results | |
|---|---|---|
| | Calc. | Found |
| N | 10.5 | 10.5 |
| C | 64.3 | 64.1 |
| H | 6.3 | 6.4 |
| S | 6.8 | 7.1 |

SYNTHESIS EXAMPLE G

Preparation of Compound D-3

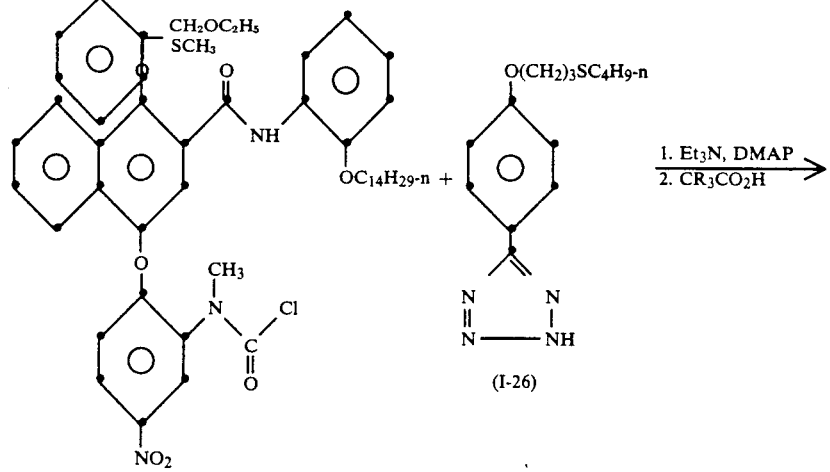

(C-3)

(I-26)

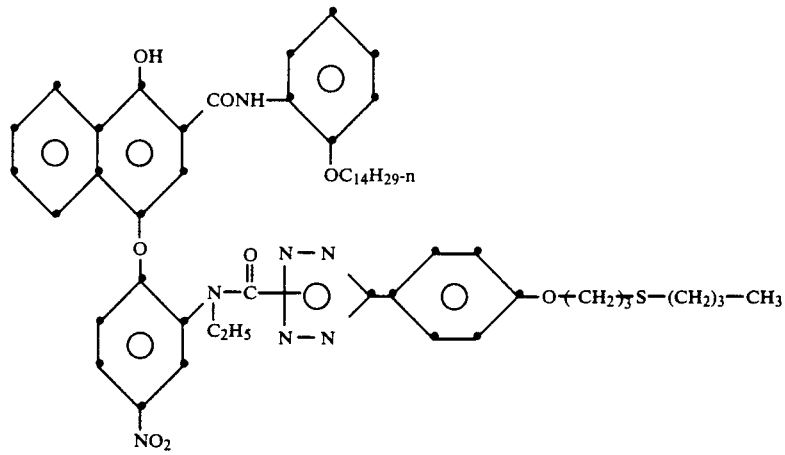

Compound D-3

A solution of 16.6 g C-2 (0.022 mole) and 5 g I-1 in pyridine was stirred overnight at room temperature and then poured into ice/HCl. The precipitate was collected by filtration and recrystallized from isopropyl alcohol. Resulting crystals were recovered by filtration. The crystals turned to a gum overnight and were then A solution of I-26 (3.80 g, 13 mmol) and triethylamine (2.63 g, 26 mmol) in 30 ml dichloromethane was added dropwise over 10 minutes to a solution of Compound C-3 (9.91 g, 13 mmol) and 4-(N,N-dimethylamino)pyridine (DMAP) (1.59 g, 13 mmol) in 70 ml dichloromethane at 5° C. The solution was stirred at room temperature for 15 minutes, cooled to 5° C and treated with 15 ml trifluoroacetic acid in one portion. The solution was stirred at room temperature for 10 minutes and then concentrated to an oil. The oil was treated with water and the product extracted with ethyl acetate. The ethyl acetate solution was dried over $MgSO_4$, filtered, and evaporated. The residue was chromatographed through 500 g silica gel using dichloromethane to give 4.98 g (40%) Compound D-3, mp 109° C.

| | Analytical Results | |
|---|---|---|
| | Calc. | Found |
| C | 66.30 | 66.20 |
| H | 6.82 | 6.74 |
| N | 10.21 | 10.15 |
| S | 5.34 | 3.21 |

SYNTHESIS EXAMPLE H

Preparation of Compound D-102

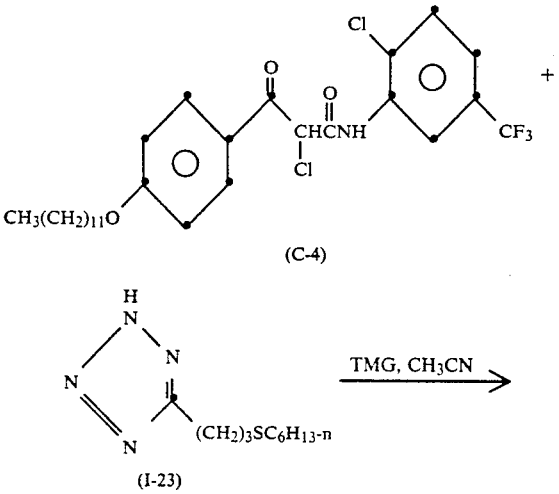

-continued

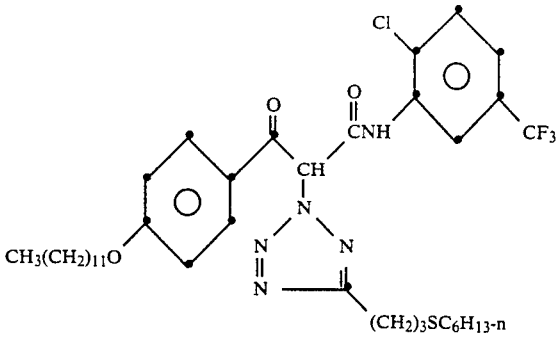

Compound D-102

A solution of C-4 (11.2 g, 20 mmol), Compound I-23 (4.56 g, 20 mmol), and tetramethylguanidine (TMG) (4.60 g, 40 mmol) in 100 ml acetonitrile was stirred at 55° C. under nitrogen for 1 hour. The solution was cooled to room temperature, diluted with diethyl ether, and washed with 5% NCl and then brine. The ether solution was dried over $MgSO_4$, filtered, and evaporated. The resulting oil was chromatographed through 300 g silica gel with 19:1 ligroin:ethyl acetate to elute the 1-substituted isomer of D-102 and then 4:1 ligroin-:ethyl acetate to obtain Compound D-102.

Recrystallization from 60 ml methanol gave 5.85 g (39%) Compound D-102, mp 52°-54° C.

| | Analytical Results | |
|---|---|---|
| | Calc. | Found |
| C | 66.66 | 60.27 |
| H | 7.10 | 7.02 |
| N | 9.31 | 9.03 |
| S | 4.26 | 4.28 |

Still other development inhibitor compounds which can be synthesized in accordance with this invention are shown below:

D-4

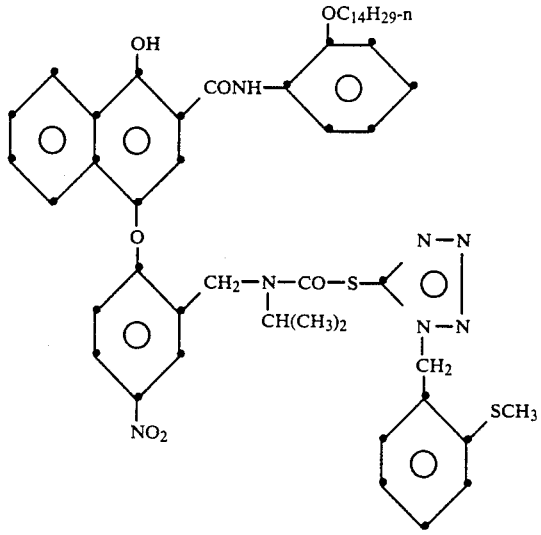

-continued
D-5
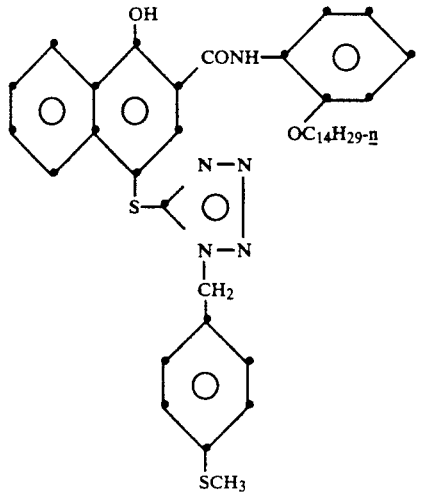
D-6
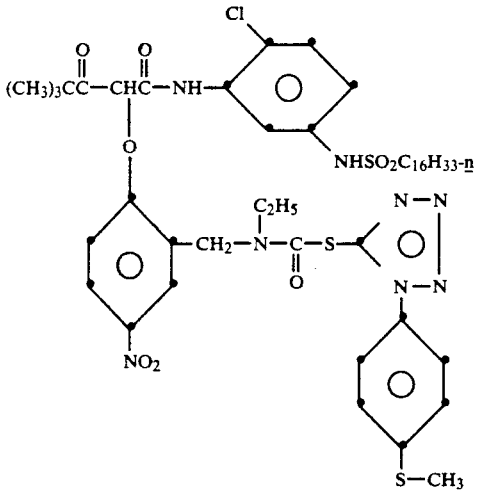
D-7
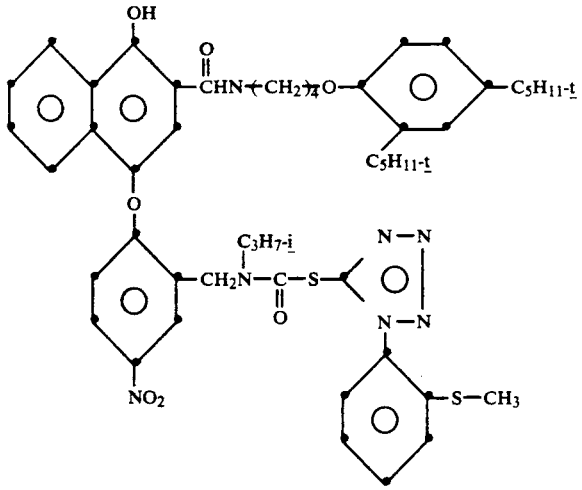

-continued
D-8
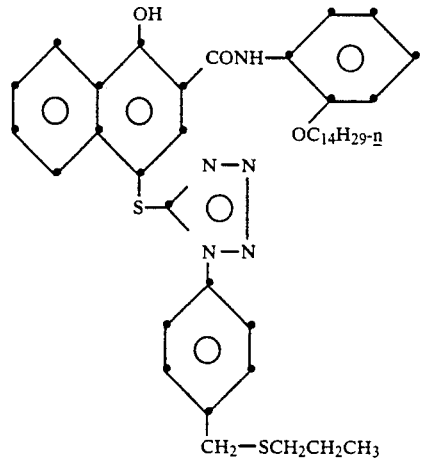
D-9
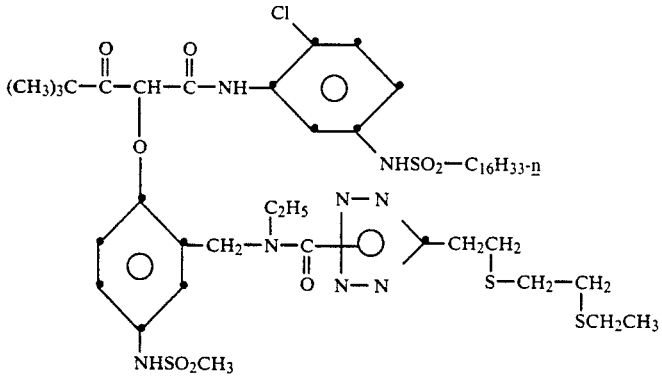
D-10
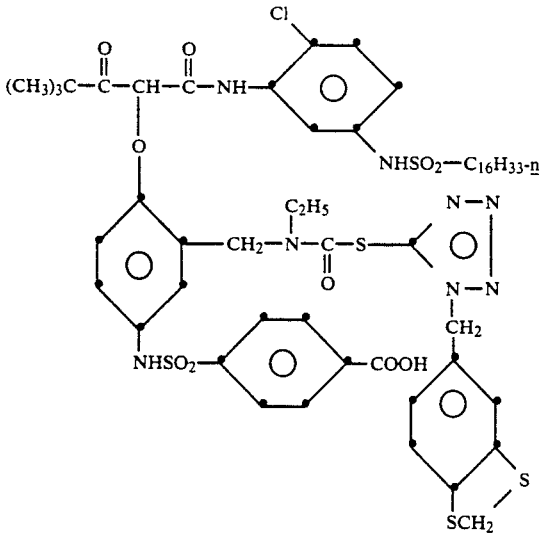

-continued
D-11
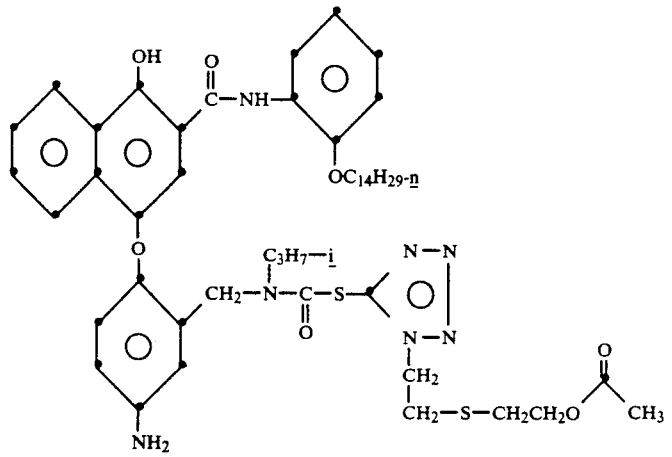
D-12
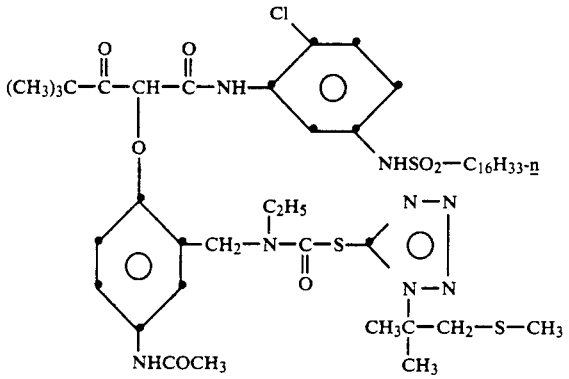
D-13
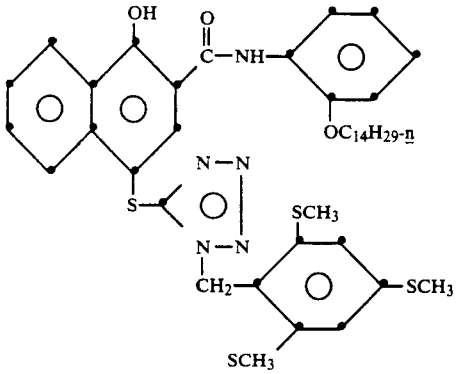
D-14
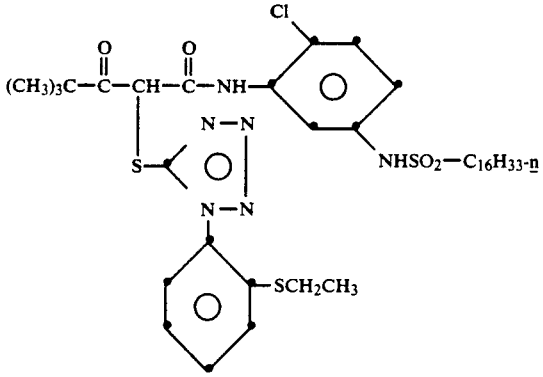

-continued
D-15
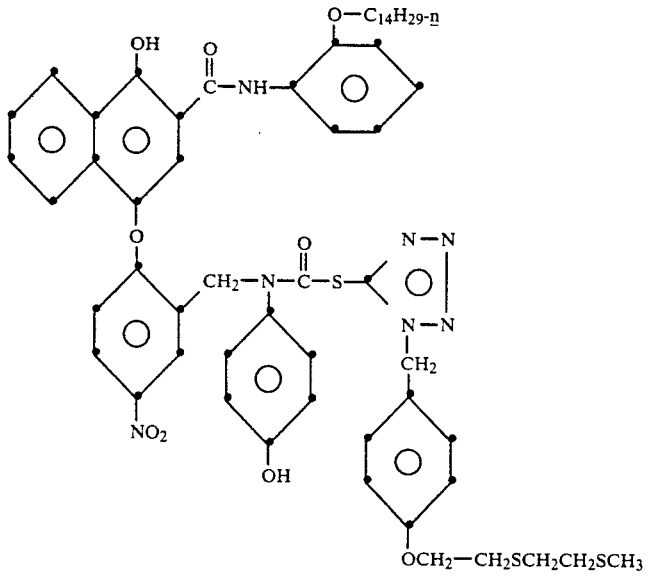
D-16
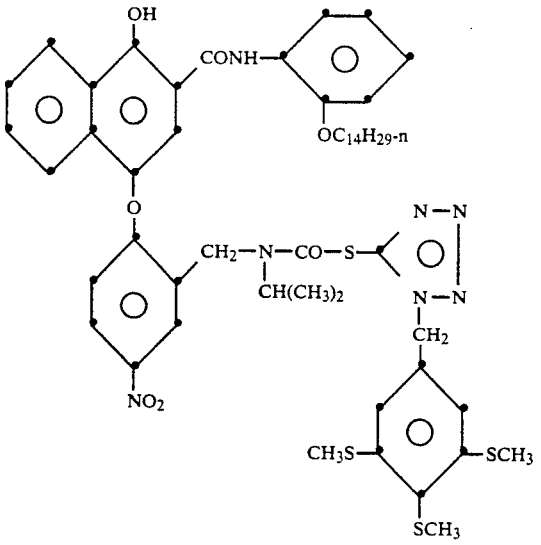

-continued
D-17
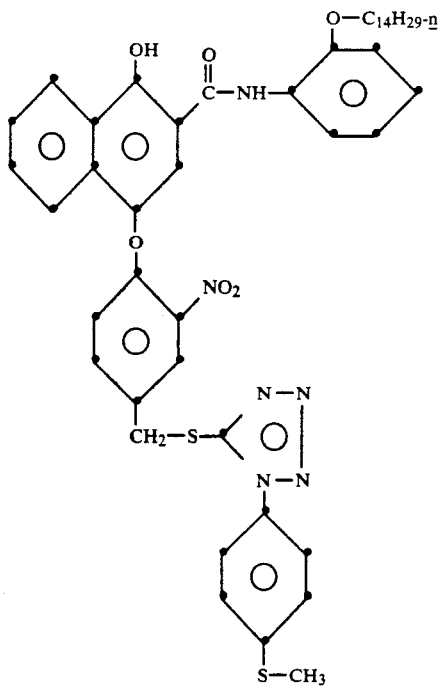
D-18
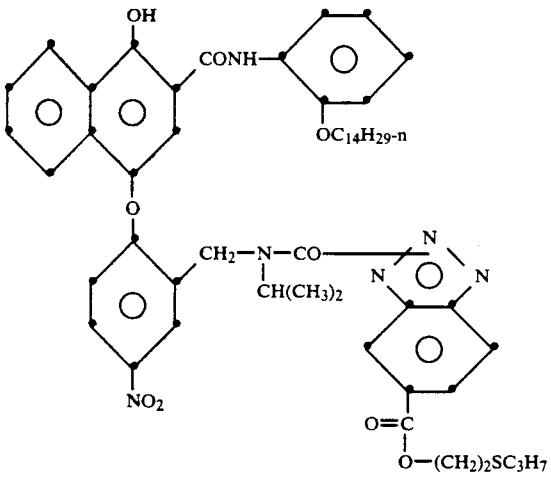
D-19
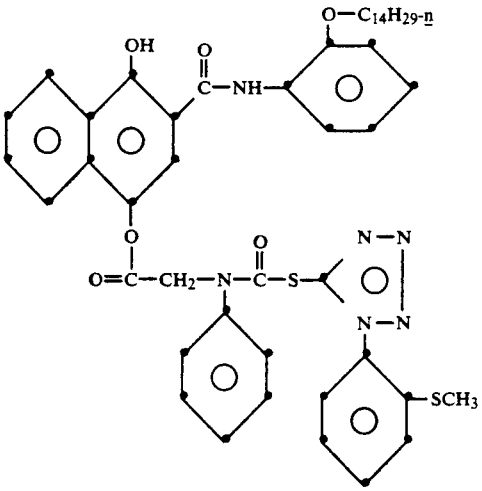

-continued
D-20
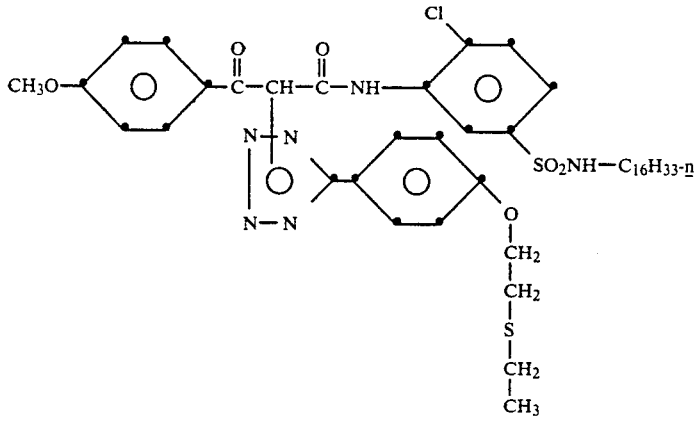
D-21
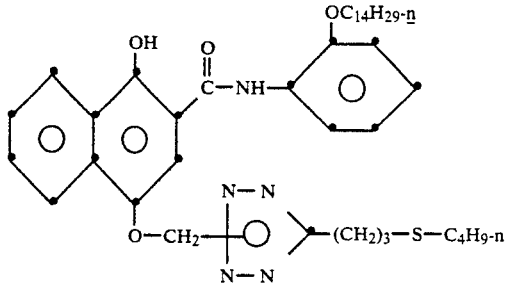
D-22
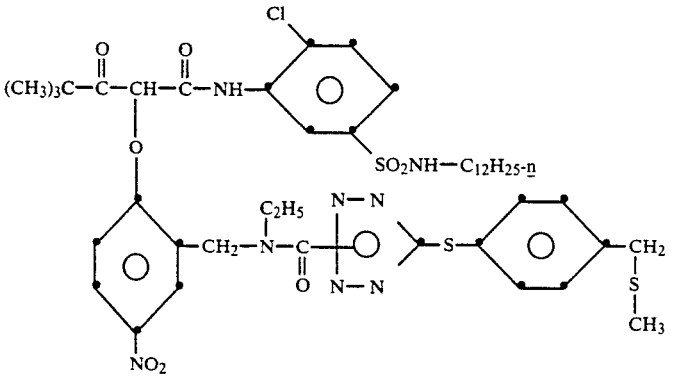
D-23
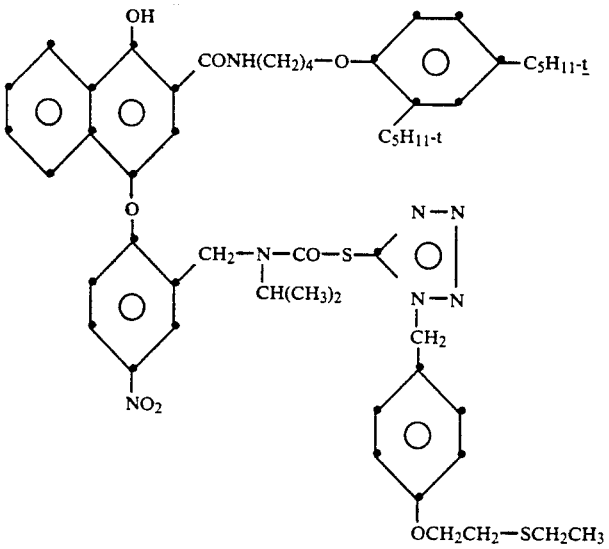

-continued
D-24
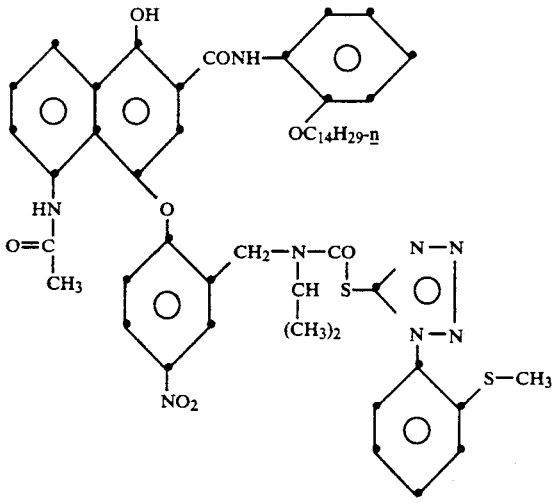
D-25
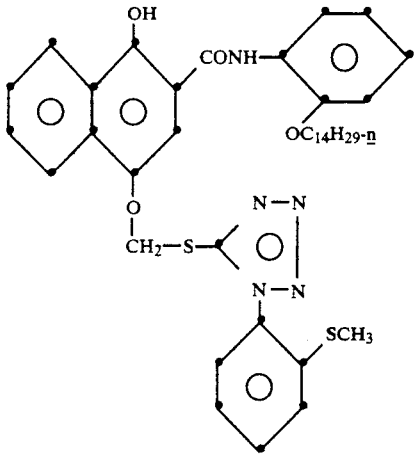
D-26
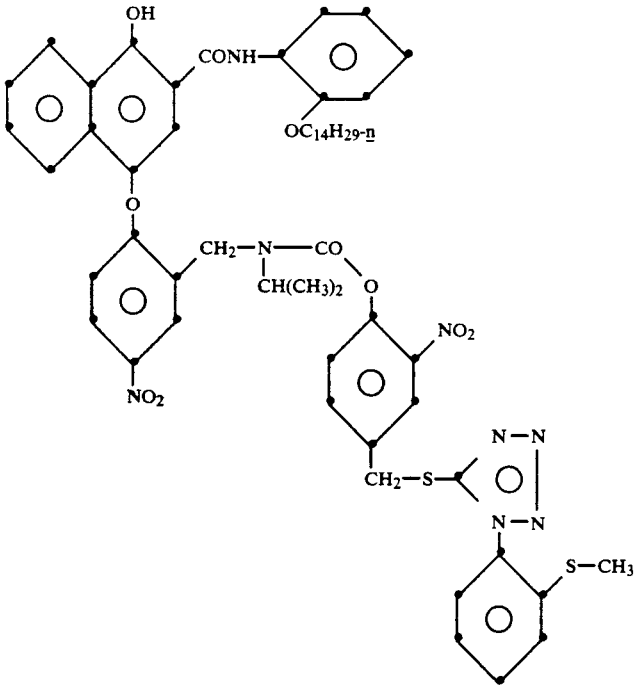

-continued
D-27
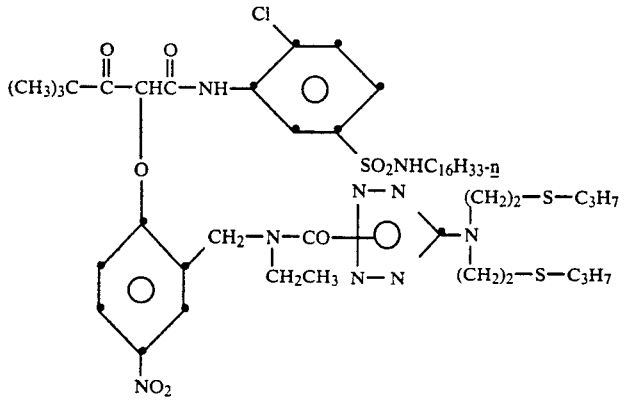
D-28
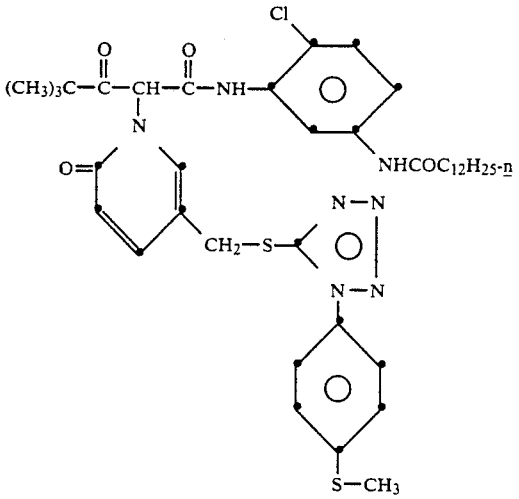
D-29
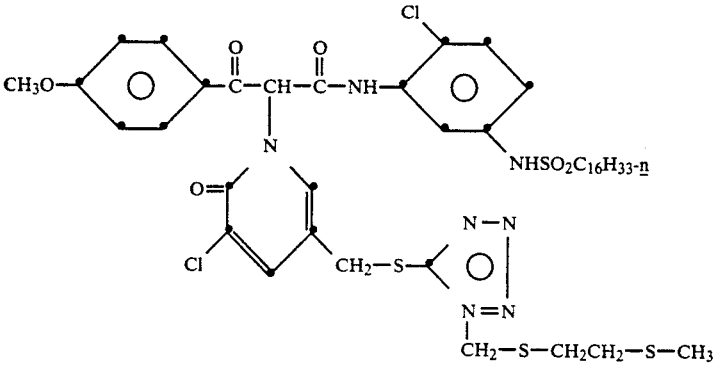

-continued
D-30
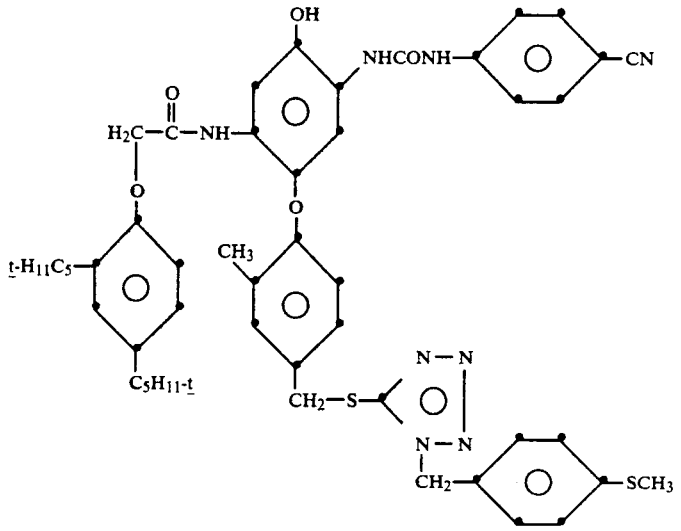
D-31
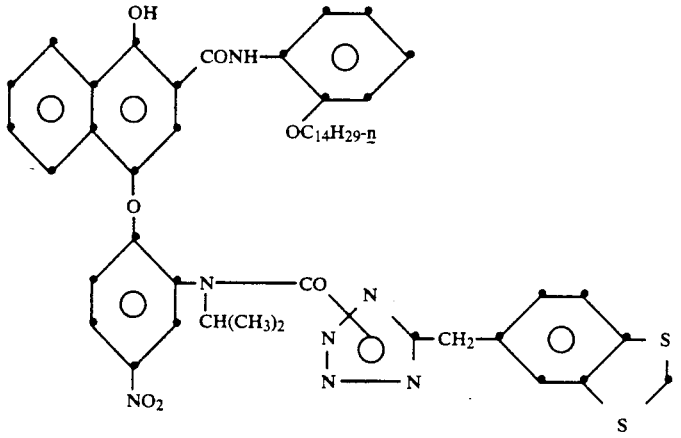
D-32
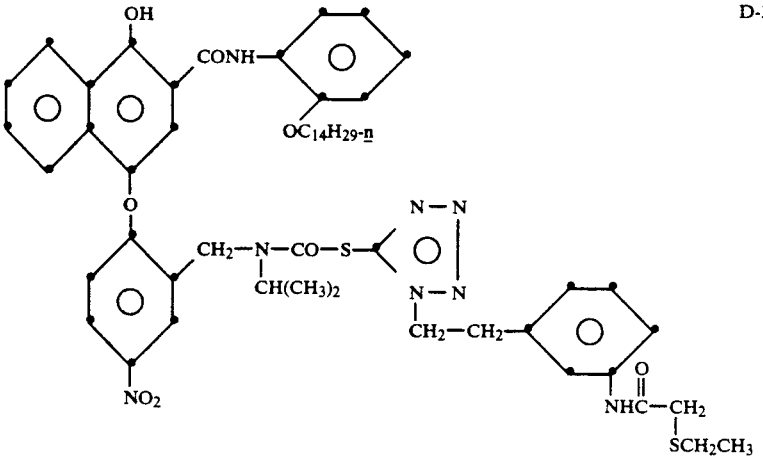

-continued
D-33
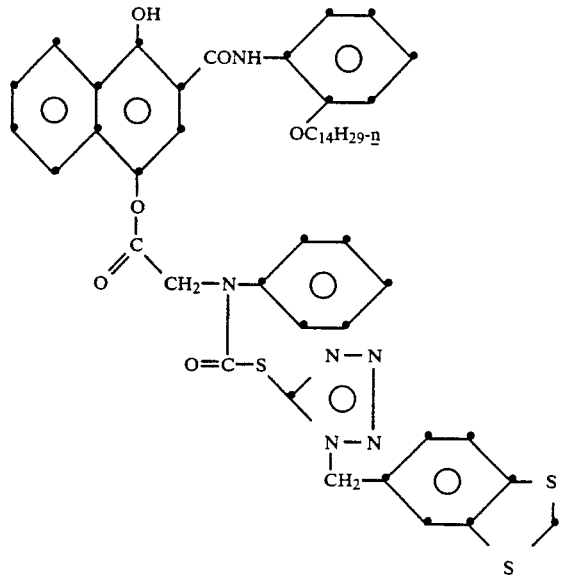
D-34
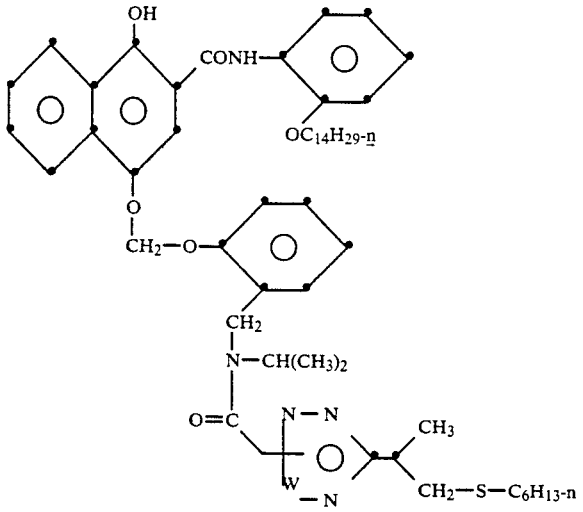
D-35
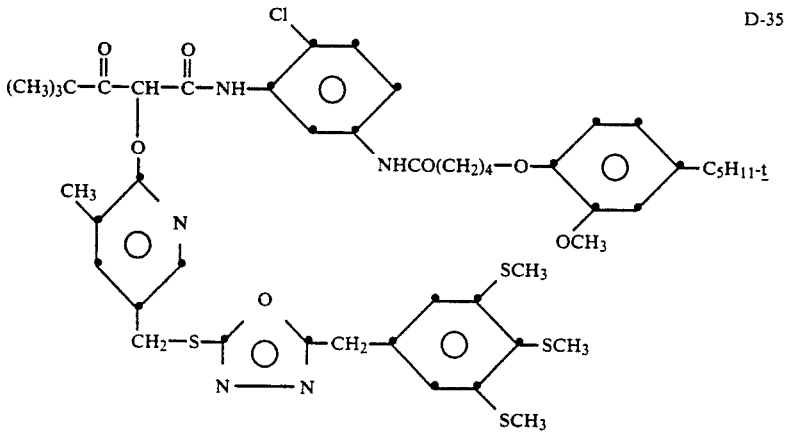

-continued
D-36
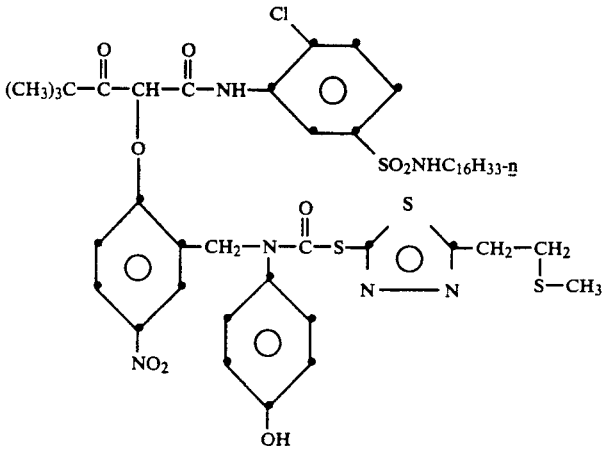
D-37
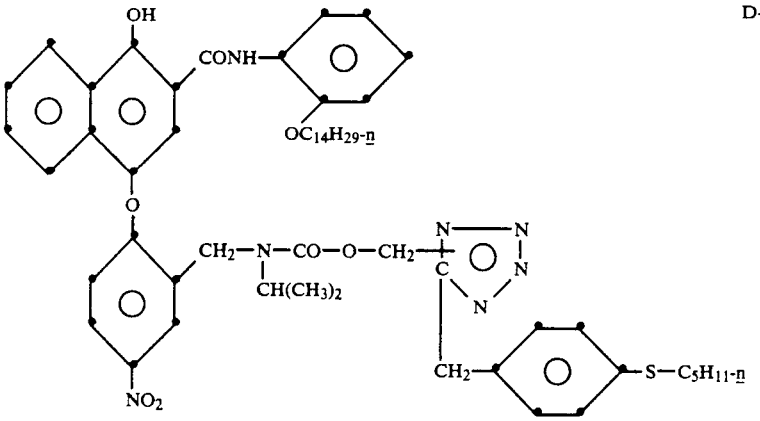
D-38
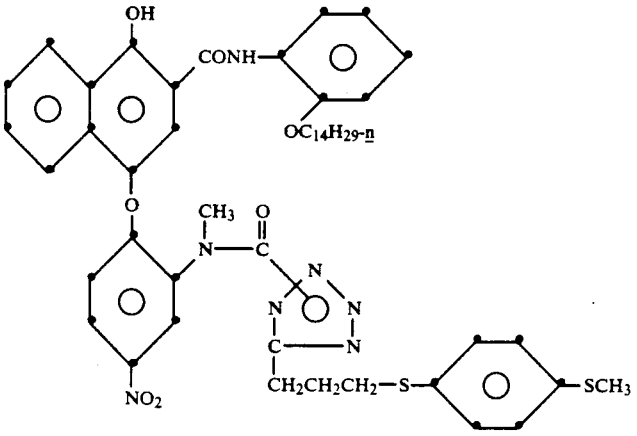

-continued
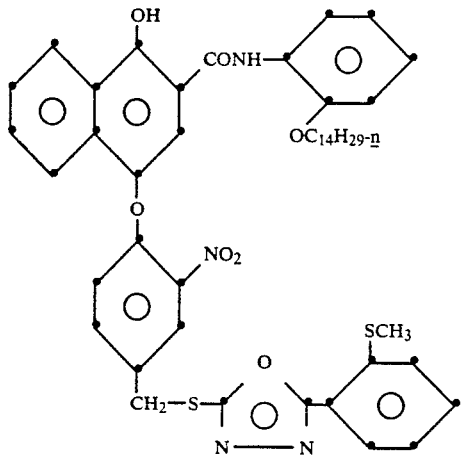
D-39
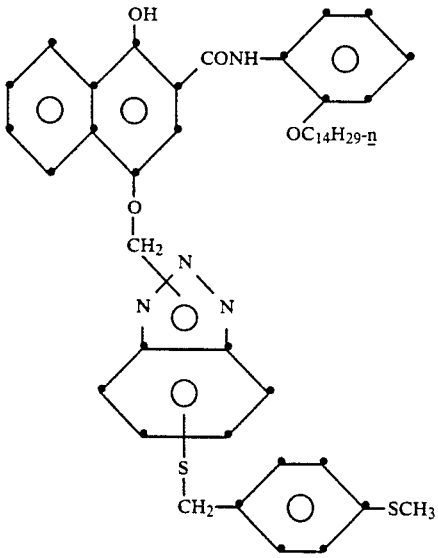
D-40
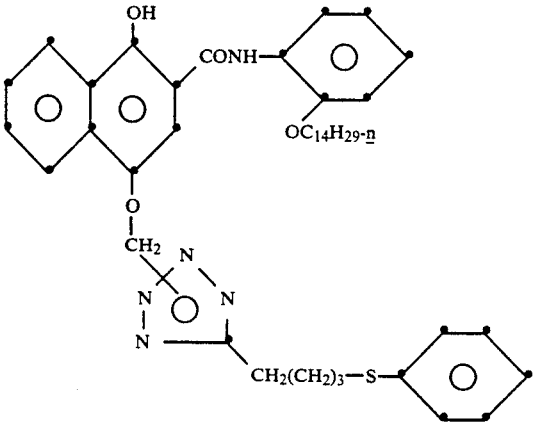
D-41

-continued
D-42
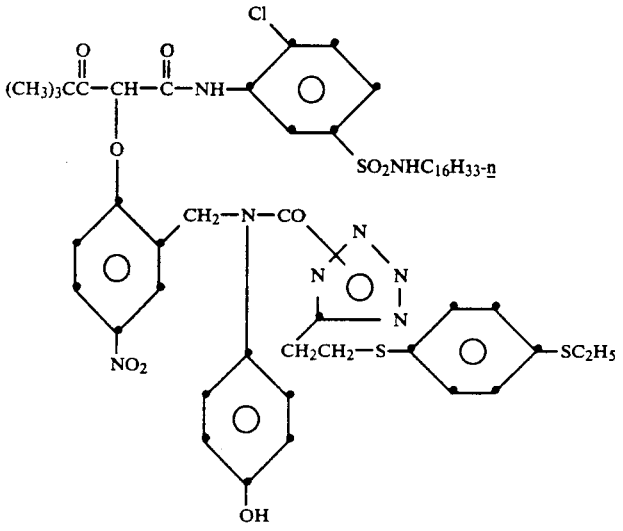
D-43
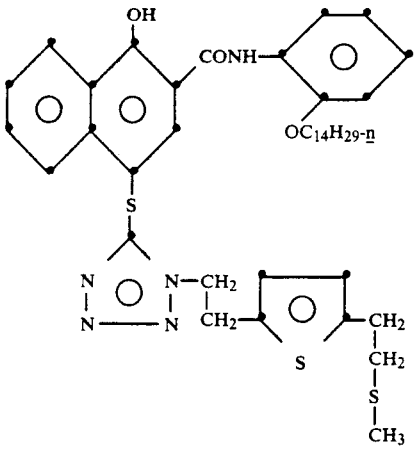
D-44
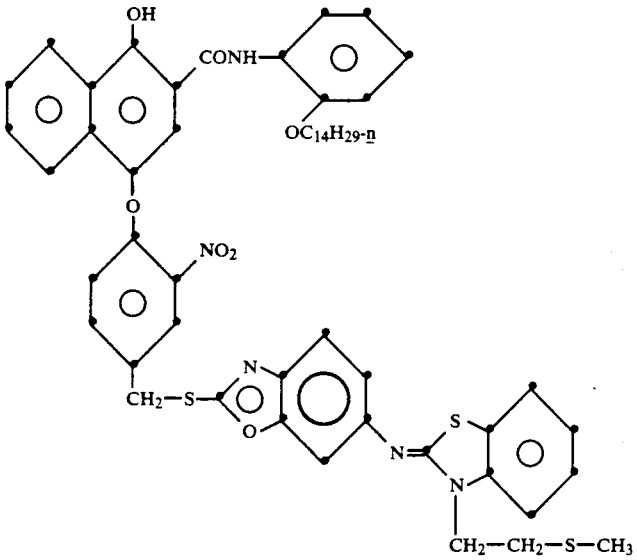

-continued
D-45
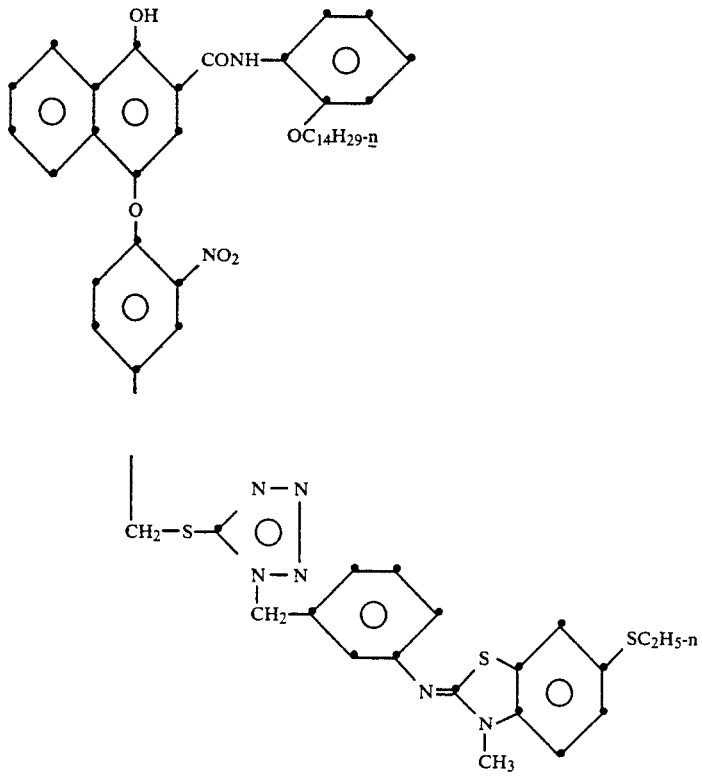
D-46
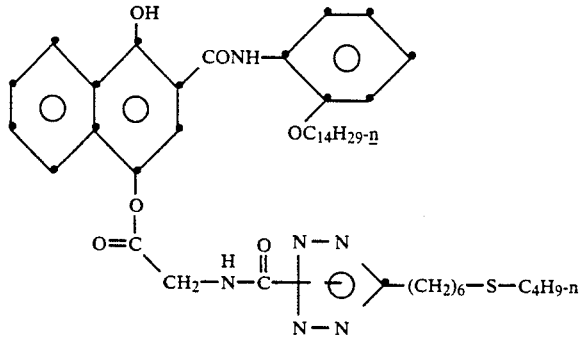
D-47
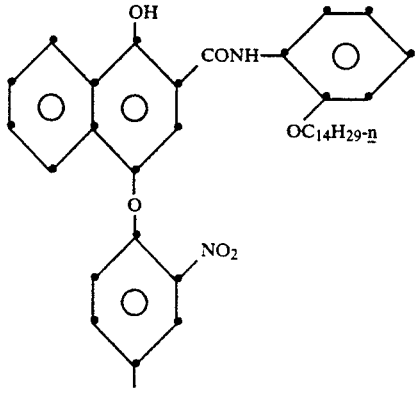

-continued
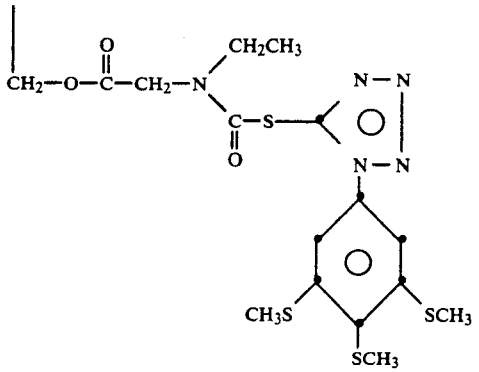
D-48
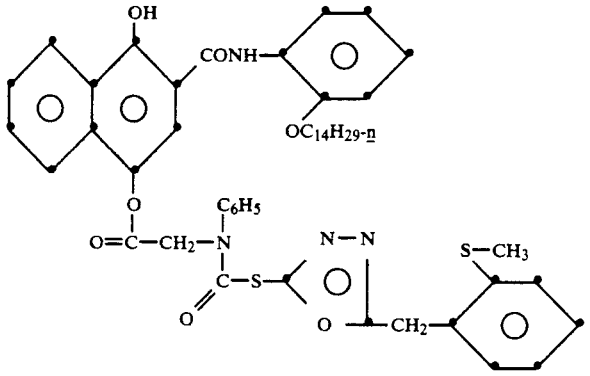
D-49
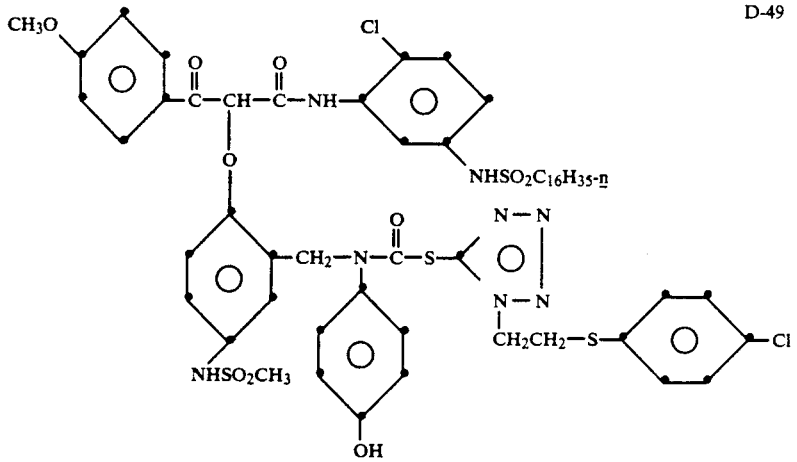

-continued
D-50
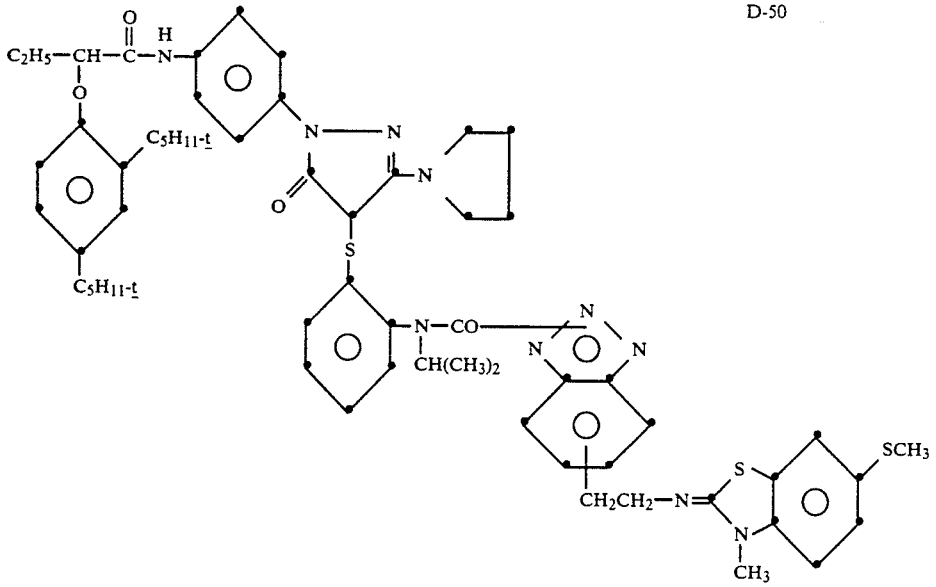
D-51
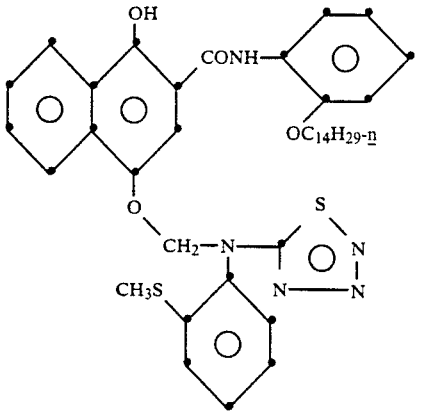
D-52
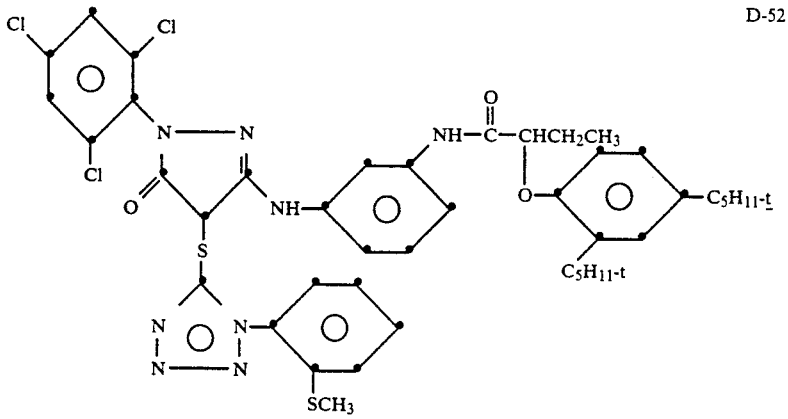

-continued
D-53
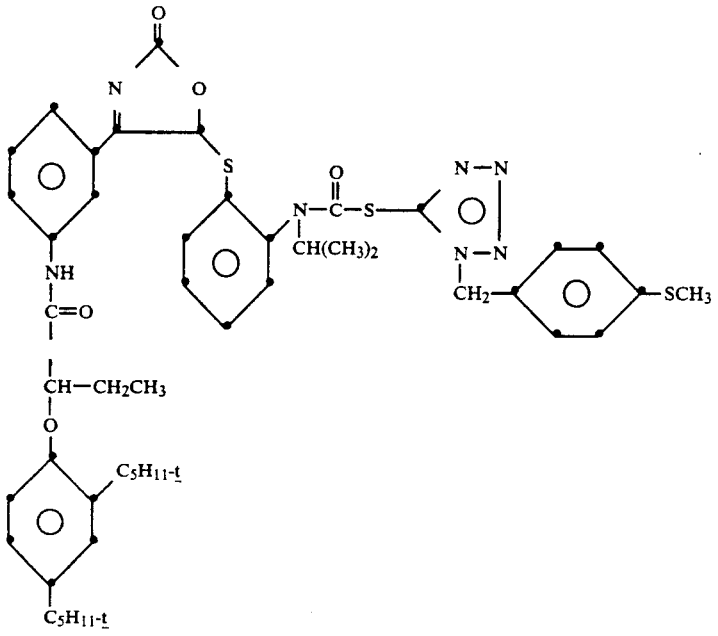
D-54
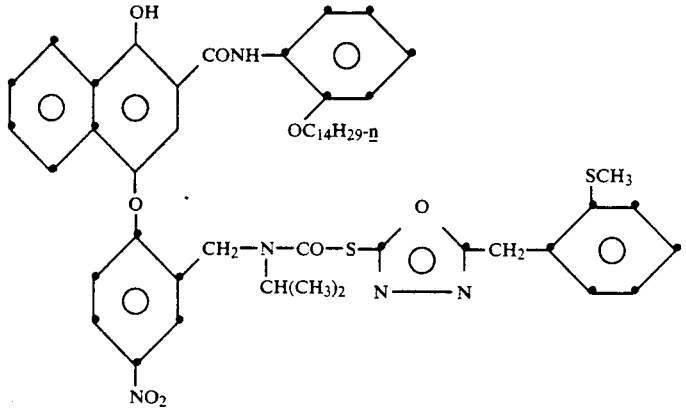
D-55
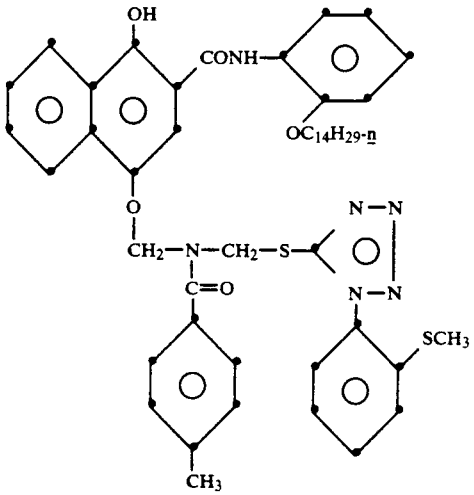

-continued
D-56
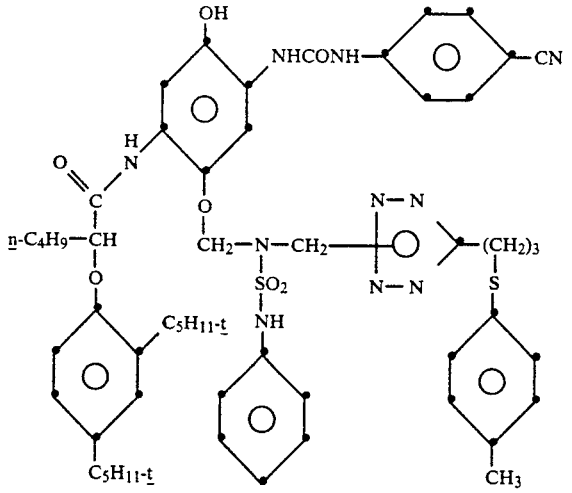
D-57
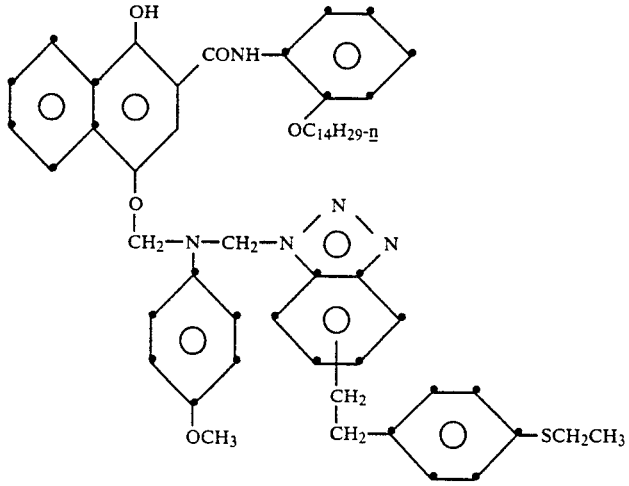
D-58
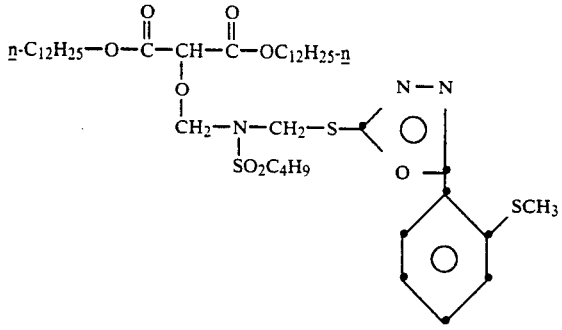
D-59
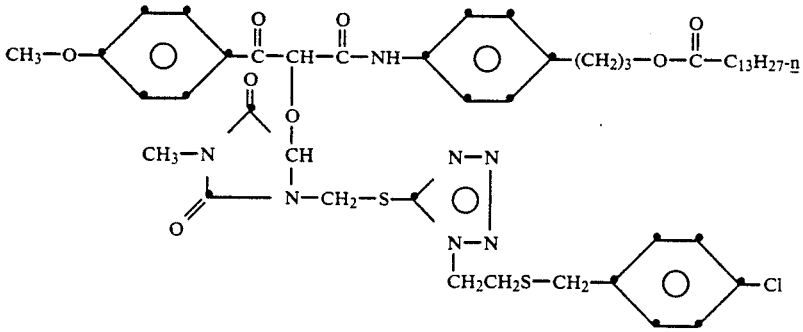

-continued
D-60
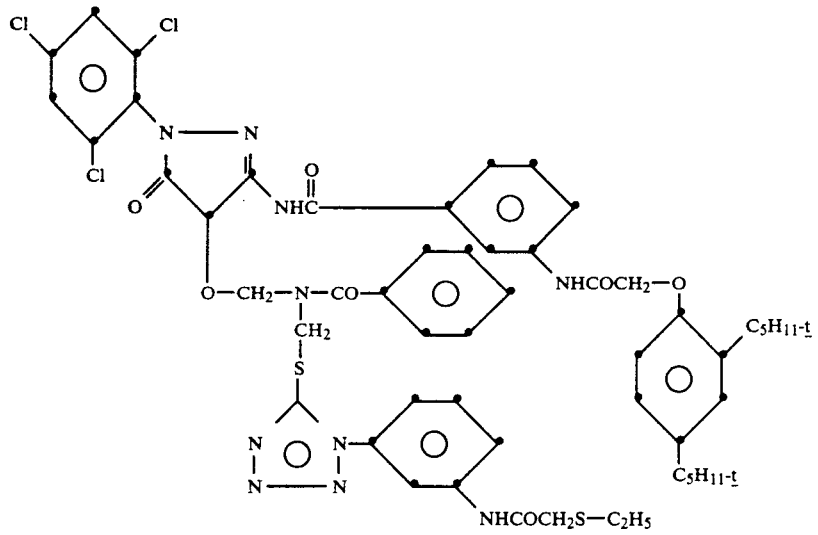
D-61
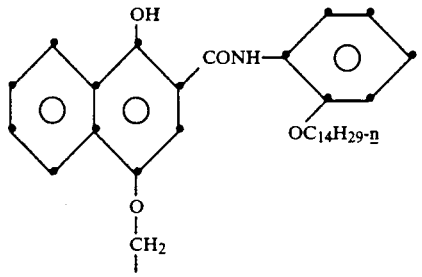
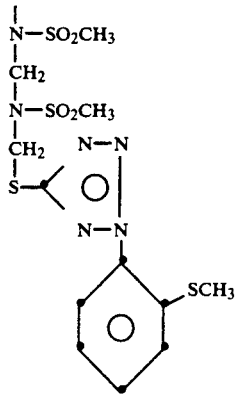

-continued
D-62
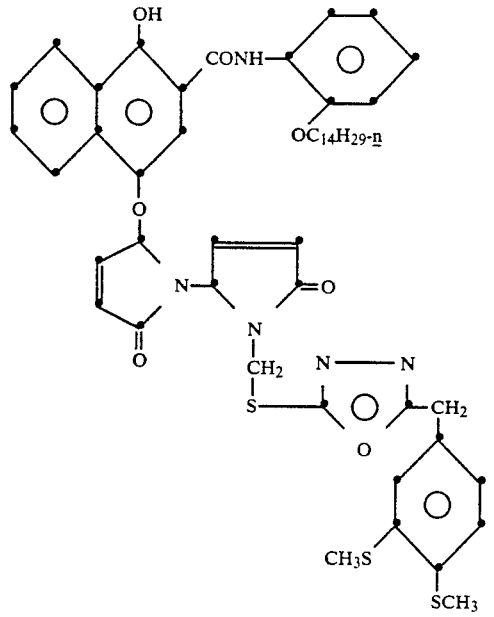
D-63
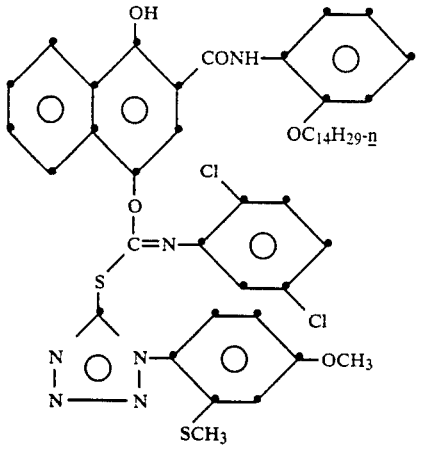
D-64
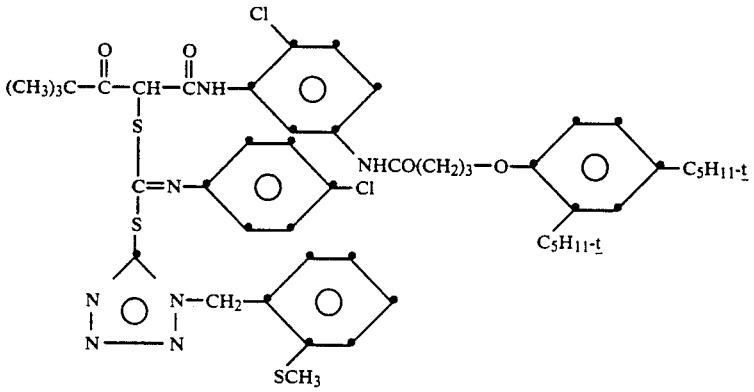

-continued
D-65
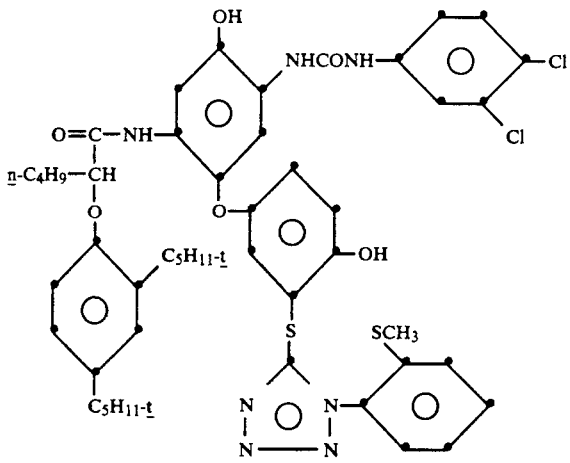
D-66
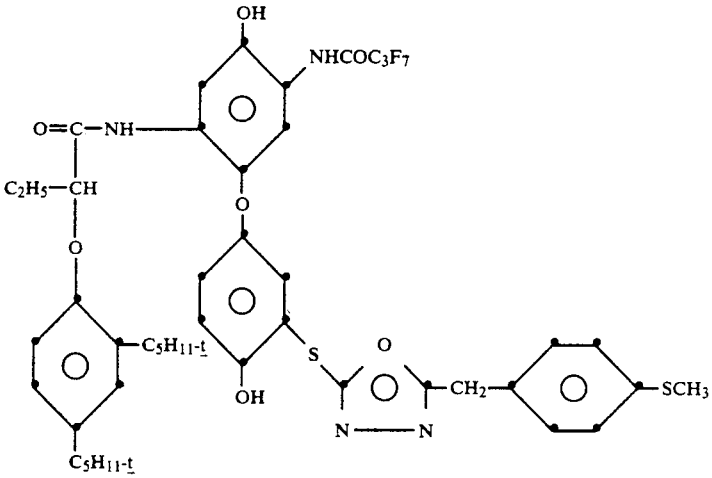
D-67
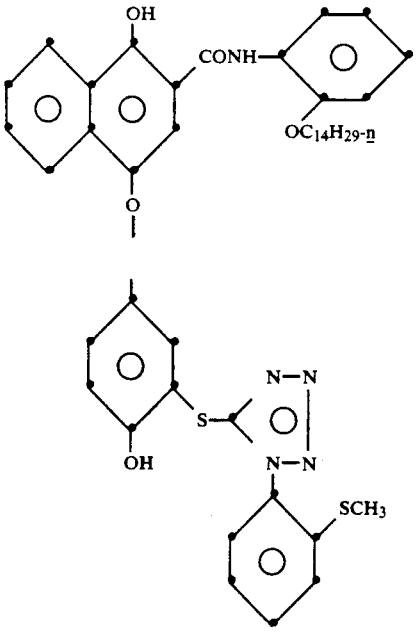

-continued
D-68
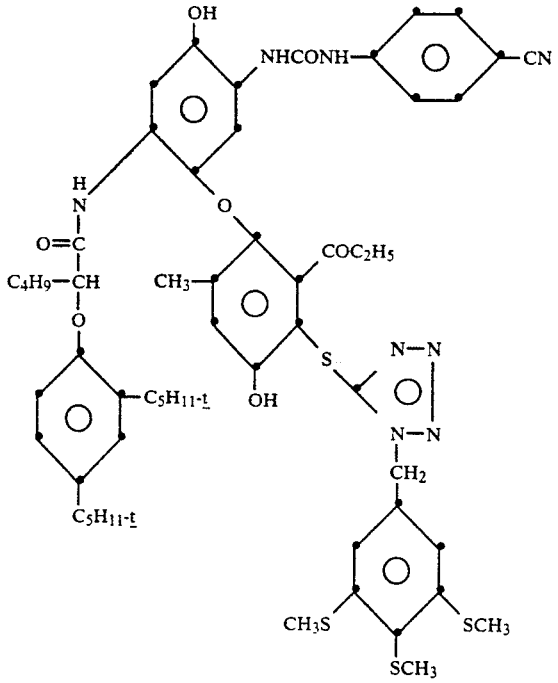
D-69
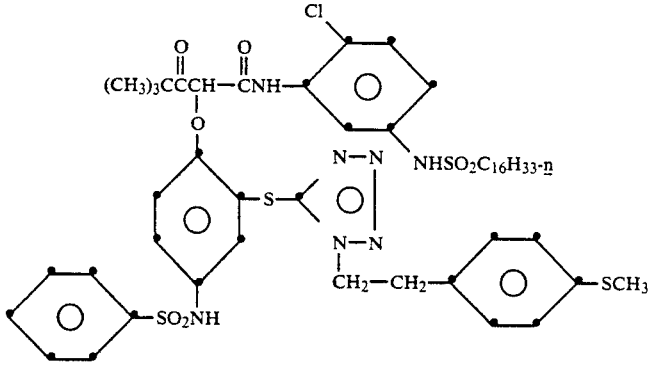
D-70
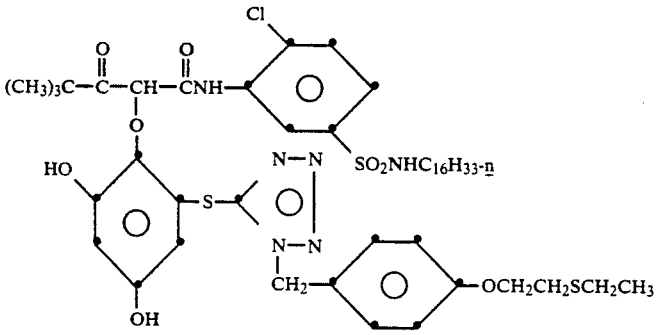

-continued
D-71
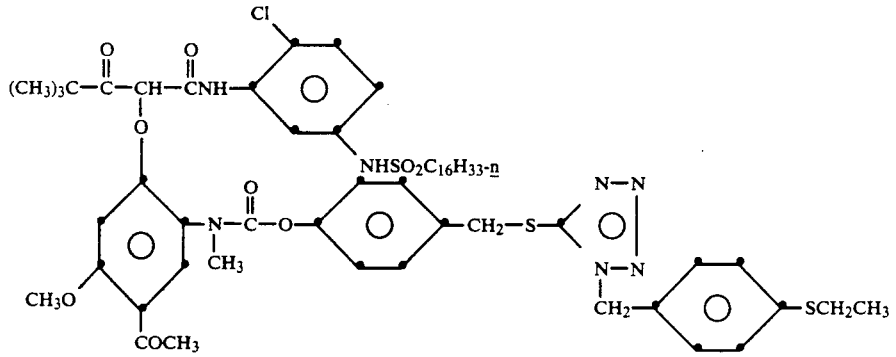
D-72
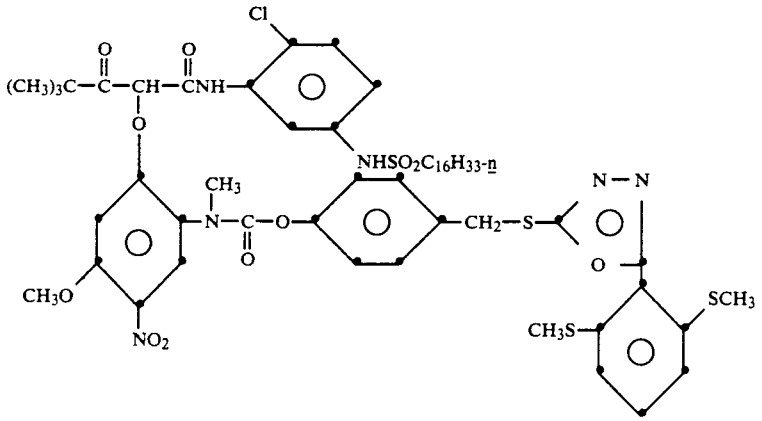
D-73
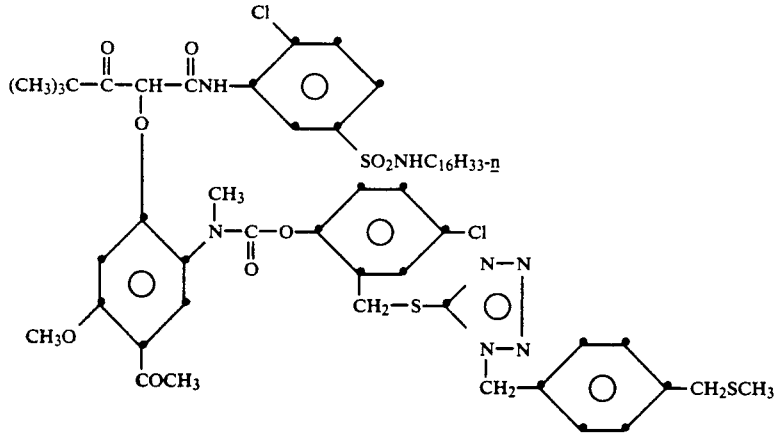
D-74
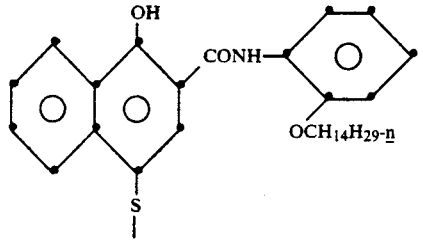

-continued
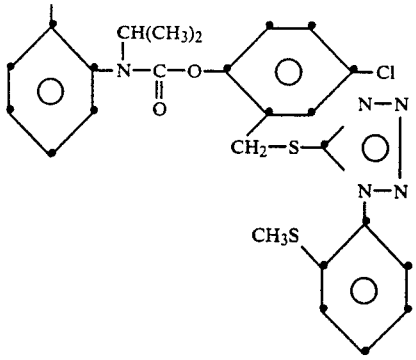
D-75
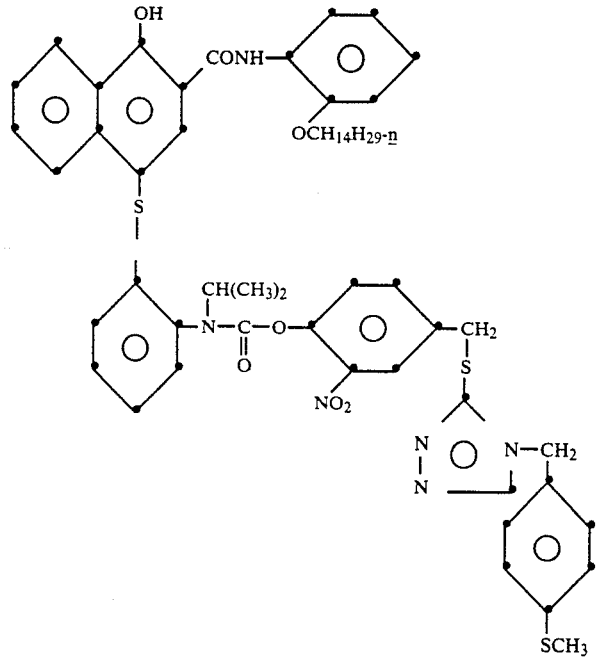
D-76
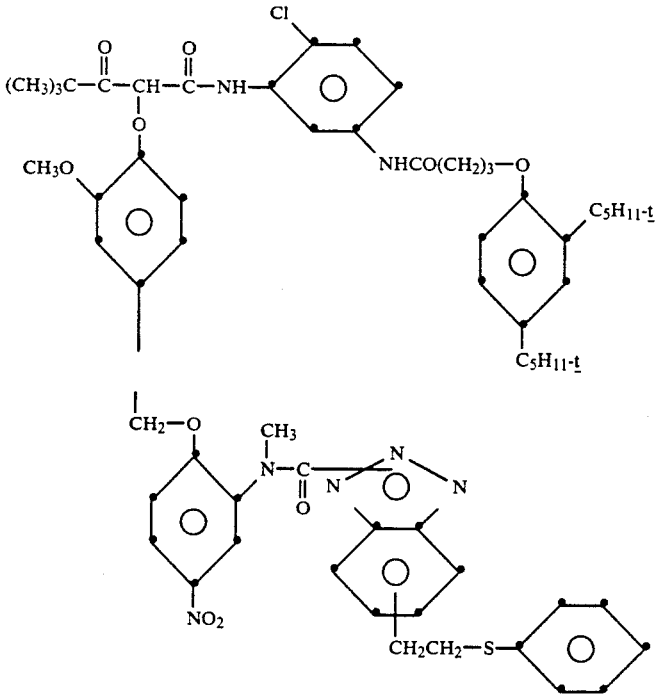

-continued
D-77
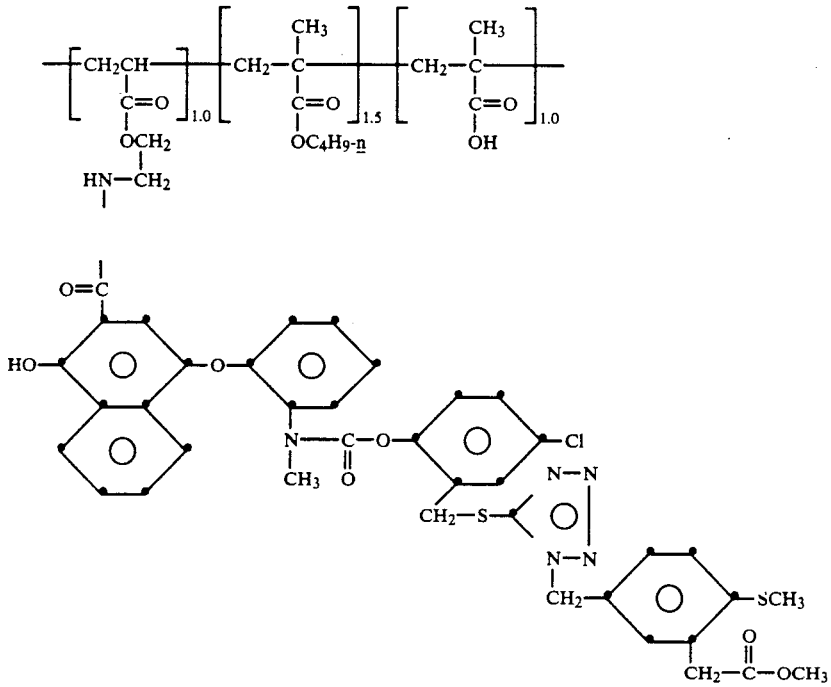
D-78
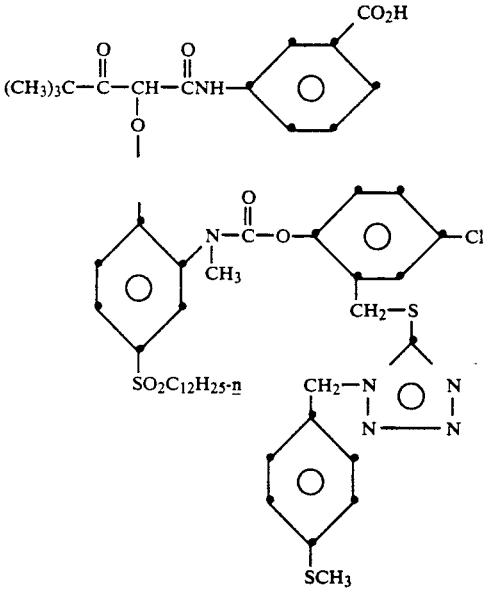
D-79
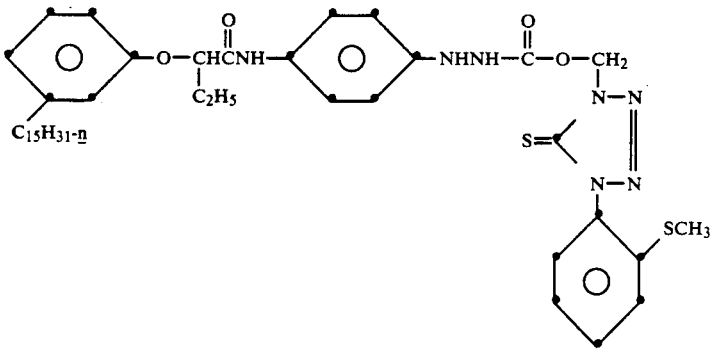

-continued
D-80
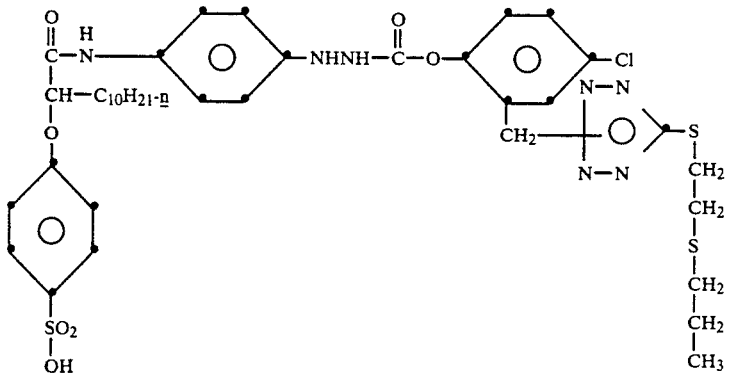
D-81
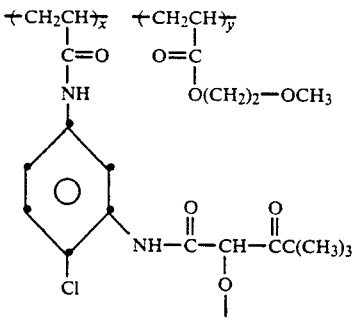
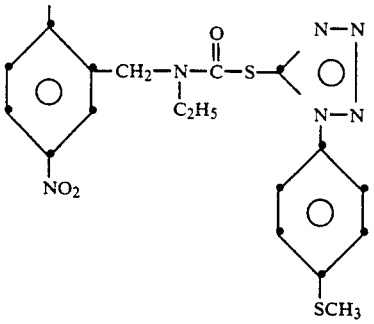
D-82
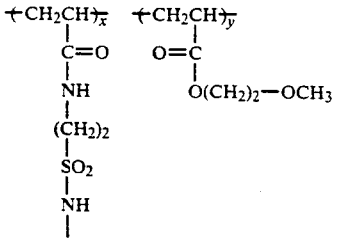

-continued
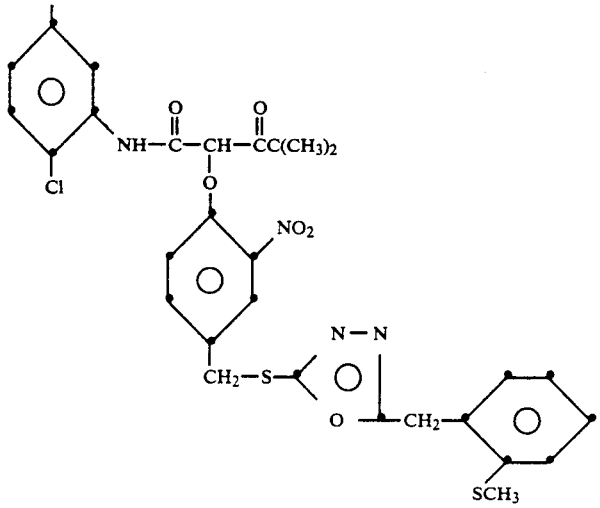
D-83
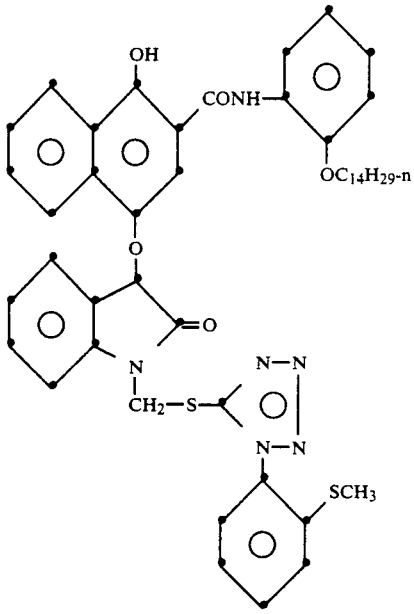
D-84
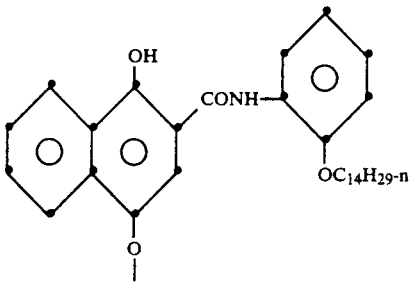

-continued
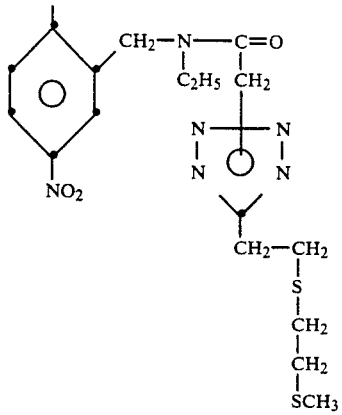
D-85
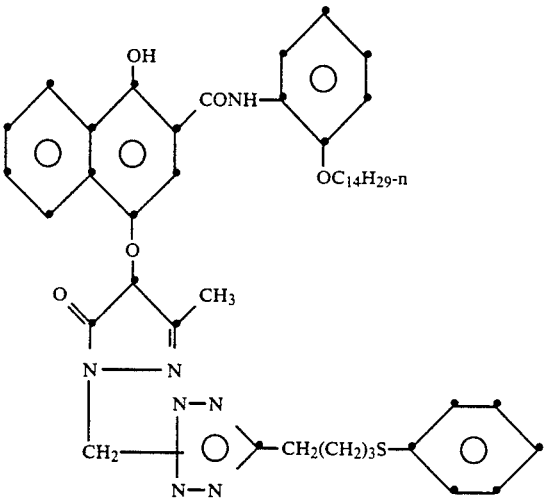
D-86
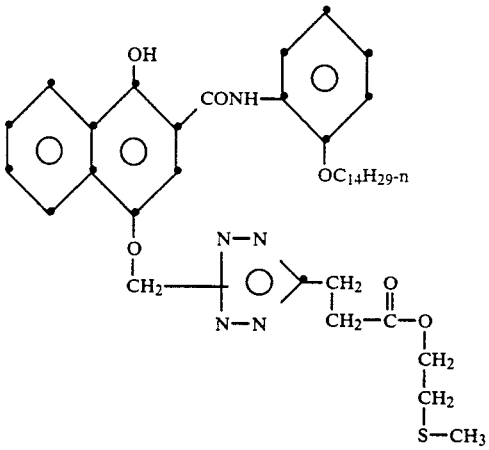
D-87
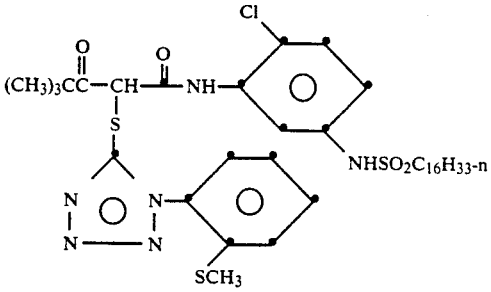

-continued
D-88
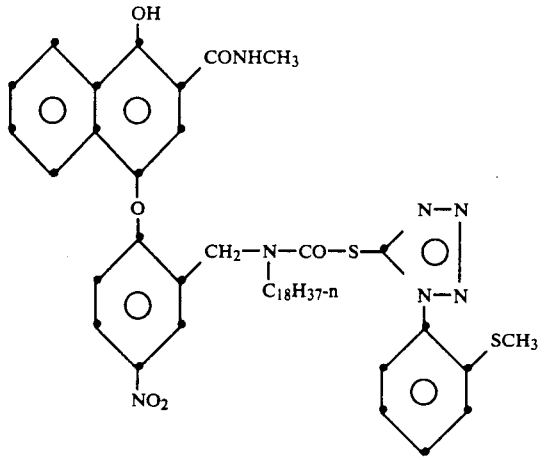
D-89
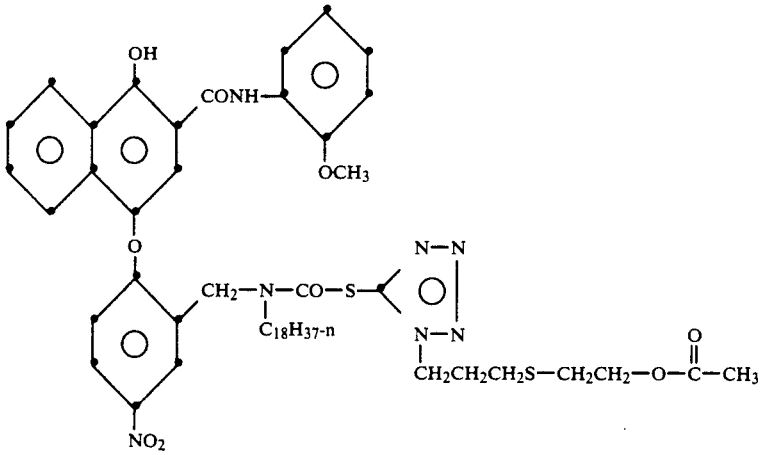
D-90
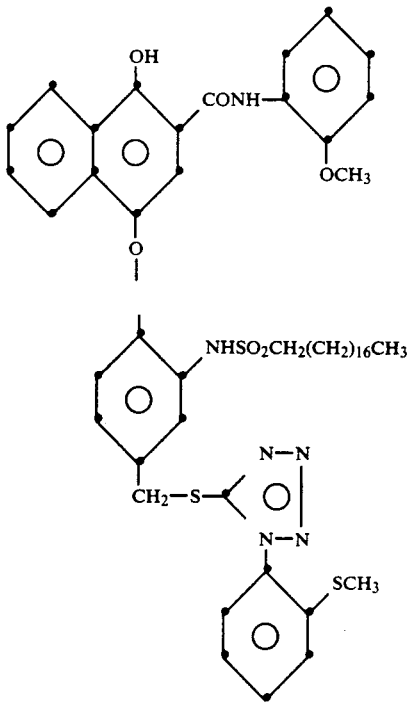

-continued
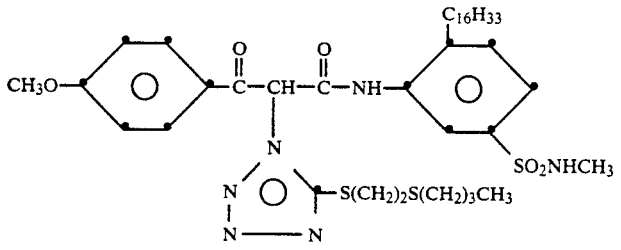
D-91
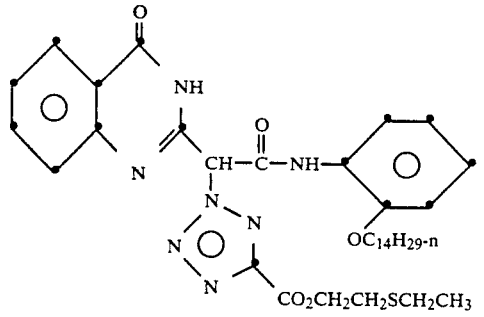
D-92
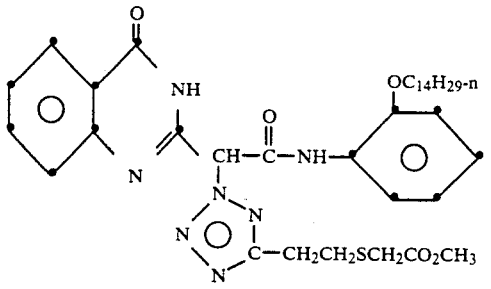
D-93
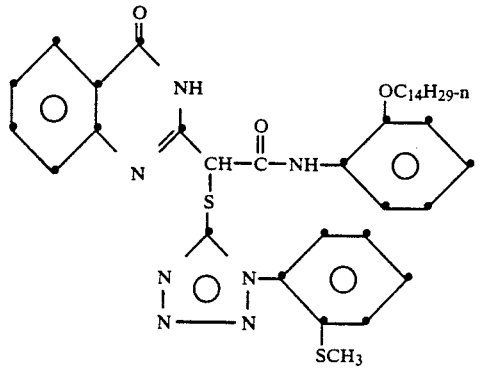
D-94

-continued
D-95
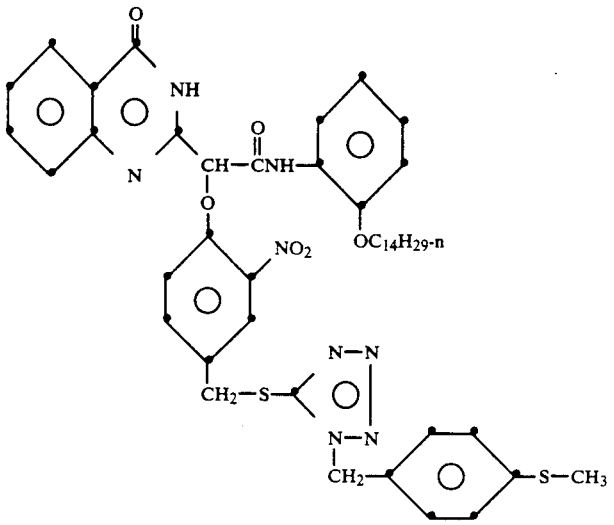
D-96
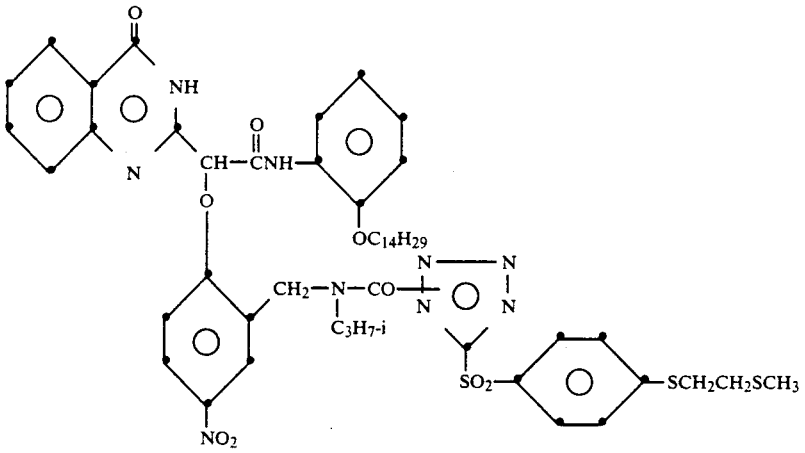
D-97
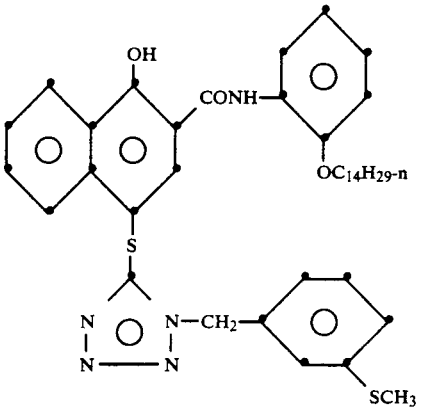

-continued
D-98
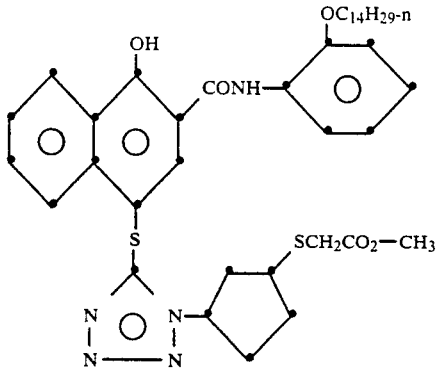
D-99
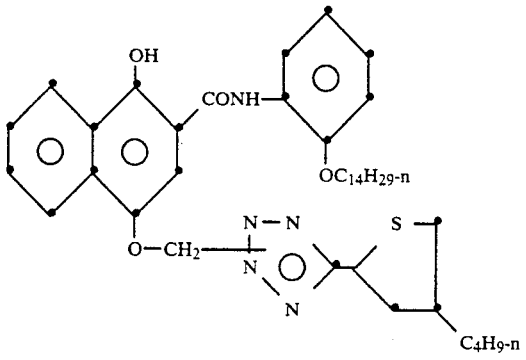
D-100
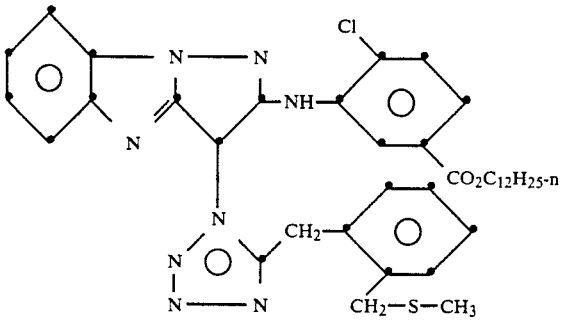
D-101
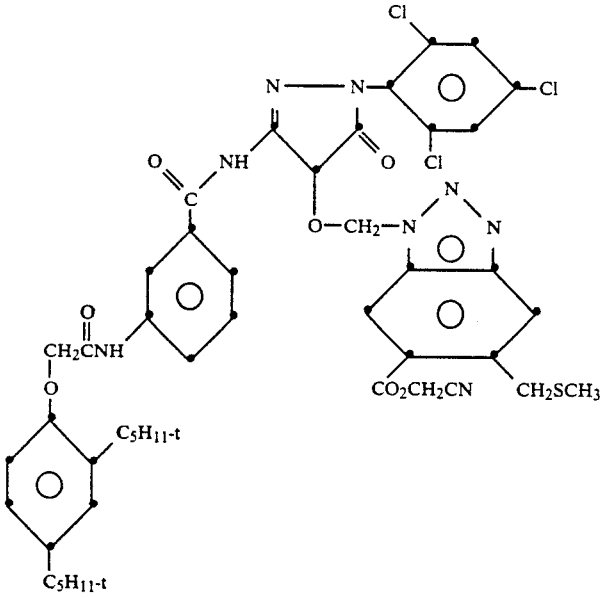

-continued
D-102
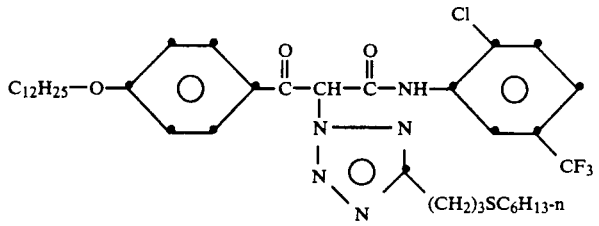
D-103
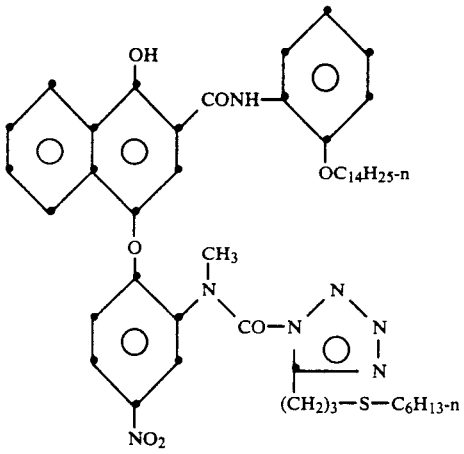
D-104
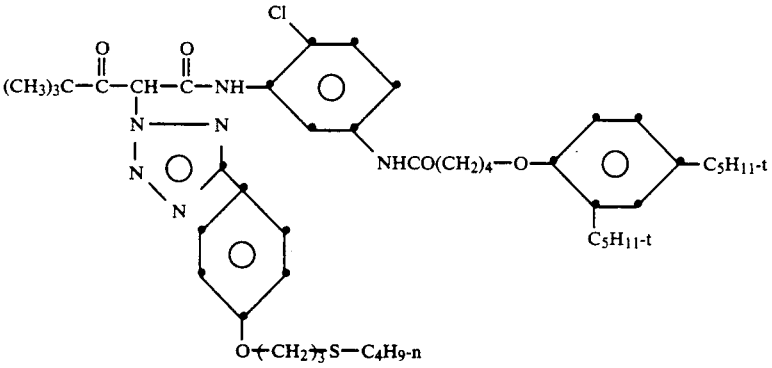
D-105
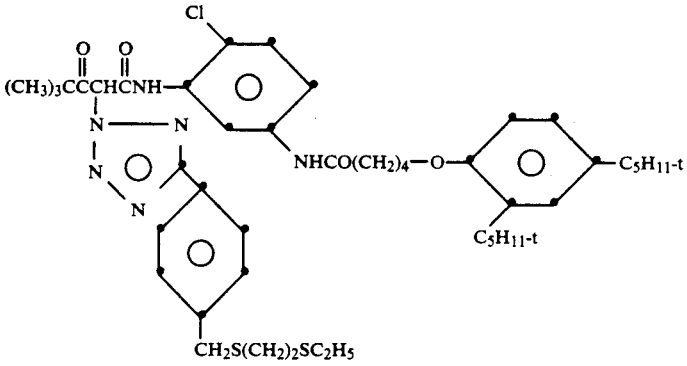

-continued

D-106

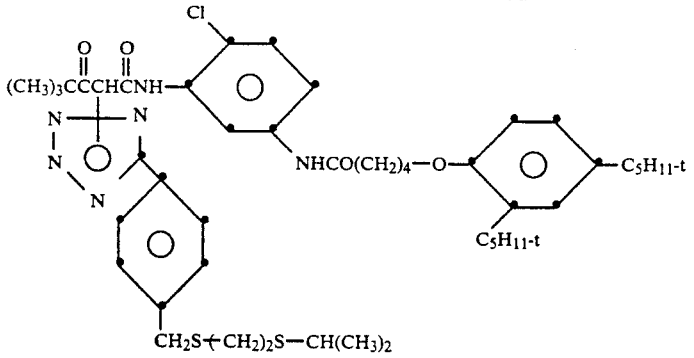

D-107

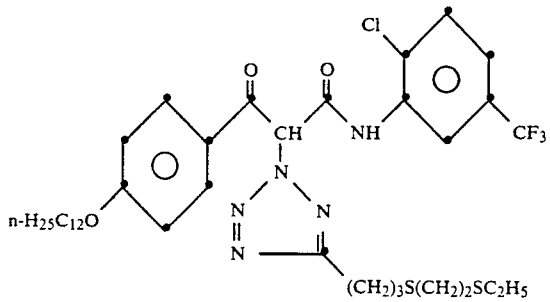

D-108

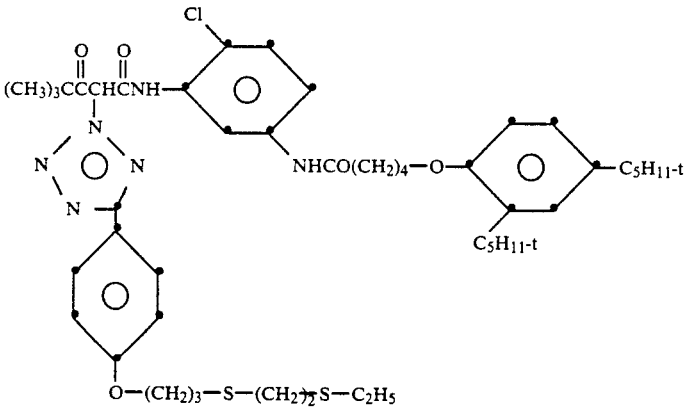

The photographic elements of this invention can be either single or multicolor elements. In a multicolor element, the yellow dye image-forming coupler and a DIR compound are usually associated with a blue-sensitive emulsion, although they could be associated with an unsensitized emulsion or an emulsion sensitized to a different region of the spectrum. Likewise, the magenta dye image-forming coupler and a DIR compound are associated with a green-sensitive emulsion and the cyan dye image-forming image coupler and a DIR compound are associated with a red-sensitive emulsion. The DIR compounds useful in this invention can be incorporated in the same photosensitive emulsion layer on which they act or in a related layer.

It is understood that DIR compounds need not be associated with all color forming photographic layers. It is also understood that the DIR compounds useful in this invention can be employed along with other DIR compounds in the same photographic material.

In an alternative format, the emulsion sensitive to each of the three primary regions of the spectrum can be disposed as a single segmented layer, e.g. as by the use of microvessels as described in Whitmore U.S. Pat. No. 4,362,806.

Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image forming units, can be arranged in various orders as known in the art.

A typical multicolor photographic element comprises a support bearing a cyan dye image-forming unit comprising at least one red sensitive silver halide emulsion layer having associated therewith at least one cyan dye-forming coupler, a magenta image-forming unit comprising at least one green-sensitive silver halide emulsion layer having associated therewith at least one magenta dye forming coupler and a yellow dye image :forming unit comprising at least one blue sensitive silver halide emulsion layer having associated therewith at least one yellow dye-forming coupler, The element can contain additional layers, such as filter layers, interlayers, overcoat layers, subbing layers, and the like.

In the following discussion of suitable materials for use in the elements of this invention, reference will be made to *Research Disclosure*, December 1978, Item 17643, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure."

The silver halide emulsions employed in the elements of this invention can be comprised of silver bromide, silver chloride, silver iodide, silver chlorobromide, silver chloroiodide, silver bromoiodide, silver chlorobromoiodide or mixtures thereof. The emulsions can include silver halide grains of any conventional shape or size. Specifically, the emulsions can include coarse, medium or fine silver halide grains. High aspect ratio tabular grain emulsions are specifically contemplated, such as those disclosed by Wilgus et al U.S. Pat. No. 4,434,226, Daubendiek et al U.S. Pat. No. 4,424,310, Wey U.S. Pat. No. 4,399,215, Solberg et al U.S. Pat. No. 4,433,048, Mignot U.S. Pat. No. 4,386,156, Evans et al U.S. Pat. No. 4,504,570, Maskasky U.S. Pat. No. 4,400,463, Wey et al U.S. Pat. No. 4,414,306, Maskasky U.S. Pat. Nos. 4,435,501 and 4,414,966 and Daubendiek et al U.S. Pat. Nos. 4,672,027 and 4,693,964. Also specifically contemplated are those silver bromoiodide grains with a higher molar proportion of iodide in the core of the grain than in the periphery of the grain, such as those described in GB 1.027,146; JA 54/48,521; U.S. Pat. Nos. 4,379,837; 4,444,877; 4,665,012; 4,686,178; 4,565,778; 4,728,602; 4,668,614 and 4,636,461; and in EP 264,954. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium and Group VIII noble metals, can be present during precipitation of the silver halide emulsion.

The emulsions can be surface-sensitive emulsions, i.e., emulsions that form latent images primarily on the surfaces of the silver halide grains, or internal latent image-forming emulsions, i.e., emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface sensitized, noble metal (e.g., gold), middle chalcogen (e.g., sulfur, selenium, or tellurium), and reduction sensitizers, employed individually or in combination, are specifically contemplated. Typical chemical sensitizers are listed in *Research Disclosure.* Item 17643, cited above, Section III.

The silver halide emulsions can be spectrally sensitized with dyes from a variety of classes, including the polymethine dye class, which includes the cyanines, merocyanines, complex cyanines and merocyanines (i.e., tri-, tetra-, and polynuclear cyanines and merocyanines), oxonols, hemioxonols, styryls, merostyryls, and streptocyanines. Illustrative spectral sensitizing dyes are disclosed in *Research Disclosure,* Item 17643, cited above, Section IV.

Suitable vehicles for the emulsion layers and other layers of elements of this invention are described in Research Disclosure Item 17643, Section IX and the publications cited therein.

In addition to the couplers described herein the elements of this invention can include additional couplers as described in Research Disclosure Section VII, paragraphs D, E, F and G and the publications cited therein. These additional couplers can be incorporated as described in Research Disclosure Section VII, paragraph C and the publications cited therein.

The photographic elements of this invention can contain brighteners (Research Disclosure Section V), antifoggants and stabilizers (Research Disclosure Section VI), antistain agents and image dye stabilizers (Research Disclosure Section VII, paragraphs I and J), light absorbing and scattering materials (Research Disclosure Section VIII), hardeners (Research Disclosure X), coating aids (Research Disclosure Section XI), plasticizers and lubricants (Research Disclosure Section XII), antistatic agents (Research Disclosure Section XIII), matting agents (Research Disclosure Sections XII and XVI) and development modifiers (Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl N,N-diethylaniline hydrochloride, 4-amino-3-methyl N-ethyl-N-$\beta$-(methanesulfonamido)ethylaniline sulfate hydrate, 4-amino-3-methyl-N-ethyl-N-$\beta$-hydroxyethylaniline sulfate, 4-amino-3-$\beta$-(methanesulfonamido)ethyl-N,N-diethylaniline hydrochloride and 4-amino-N-ethyl N-(2-methoxyethyl)-m-toluidine di-p-toluenesulfonic acid.

With negative-working silver halide, the processing step described above provides a negative image. The described elements are preferably processed in the known C-41 color process as described in, for example, the British Journal of Photography Annual of 1988, pages 196–198. To provide a positive (or reversal) image, the color development step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver or silver halide, washing, and drying.

The term "associated therewith" as used herein is intended to mean that the materials can be in either the same or different layers so long as the materials are accessible to one another.

The following examples are intended as further illustrations of this invention. In these examples reference to "causer" or to "causer layer" identifies the source of a compound responsible for a subsequently observed interimage effect. Reference to "receiver" or to "receiver layer" identifies that part of a photographic material where the interimage effect is primarily observed.

EXAMPLE 1

Sharpness and Interimage Effects

Eight color photographic elements (coatings numbered 1–8 in Table I) were prepared having the following schematic layer structure and using silver bromoiodide emulsions containing 6.4 mole % iodide (numerical values denote coating coverages in mg/m$^2$ and the silver halide values are for equivalent weights of silver):

| | |
|---|---|
| Overcoat: | Gelatin - 2500; Bis(vinylsulfonylmethyl) ether hardener at 1.75% by weight of total gelatin |
| Layer 1: (causer) | Gelatin - 2400; Green-sensitized AgBr I - 1600; Cyan dye forming coupler (IC-1) - 750; DIR Compound indicated in Table I |
| Interlayer: | Gelatin - 620; 2,5-didodecylhydroquinone - 115 |
| Layer 2: (receiver) | Gelatin - 2400; Red-sensitized AgBrI - 1600; Yellow dye forming coupler (IC-2) - 1300 |
| Film Support: | Gelatin - 2452; Antihalation gray silver - 324 |

IC-1

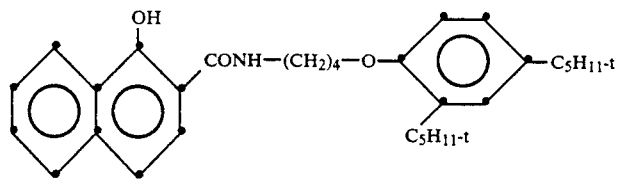

IC-2

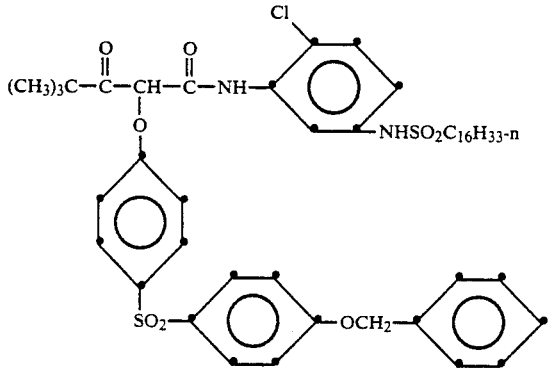

IC-3

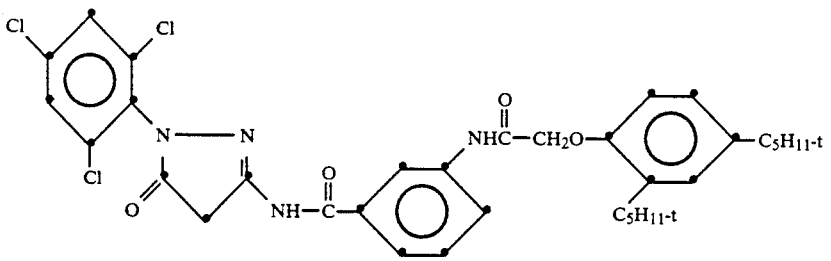

The dye-forming couplers IC-1 and IC-2 were each dispersed in half their weight of di-n-butyl phthalate, the dye forming coupler IC-3 was dispersed in half its weight of tri-cresyl phosphate and the DIR compounds were each dispersed in twice their weight of diethyl lauramide.

For evaluation of the DIR coupler effect on "causer" layer gamma and sharpness, the samples were exposed through a graduated-density test object and a Kodak Wratten 99 (green) filter. This exposed photographic layer 1.

For interimage evaluation, the samples were exposed through a graduated-density test object and a Kodak Wratten 12 (minus blue) filter. This exposed both layers 1 and 2.

Sharpness was evaluated by calculating CMT acutance values for 16mm film or by calculating AMT acutance values for a Disc type film or for a 35 mm film.

Calculations employed the following formulas in which the cascaded area under the system modulation transfer curve is shown in equation (21.104) on page 629 of The Theory of the Photographic Process, 4th edition, 1977, edited by T. H. James:

$$CMT = 100 + 42 \log [\text{cascaded area}/5.4782M]$$

$$AMT = 100 + 66 \log [\text{cascaded area}/2.6696M']$$

where M=11.8 for a 16mm film, and M'=3.8 for a 35 mm film or 11.5 for a DISC type film.

This technique is described in an article entitled. "An Improved Objective Method for Rating Picture Sharpness: CMT Acutance", by R. G. Gendron, Journal of the SMPTE, 82 1009–12 (1973).

The photographic materials were then processed at 38° C. as follows:

| | Minutes |
|---|---|
| Color Developer | 2.75 |
| Stop (5% Acetic Acid) | 2 |
| Wash | 2 |
| Bleach $K_3Fe(CN)_6$ | 2 |
| Fix | 2 |
| Wash | 2 |

The color developer composition was:

| | grams/liter |
|---|---|
| $K_2SO_3$ | 2.0 |
| 4-amino-3-methyl-N-ethyl beta-hydroxyethylaniline sulfate | 3.35 |
| $K_2CO_3$ | 30.0 |
| KBr | 1.25 |
| KI | 0.0006 |
| adjusted to pH = 10.0 | |

The oxidized color developing agent generated by development of exposed silver reacts with adjacent dye image-forming compounds and DIR compound, if present, to form dyes and to release inhibitor (or inhibitor precursor) in photographic layer 1. The development inhibiting effects of inhibitor released from the DIR compound were assessed by monitoring the gamma of photographic layer 1. The sharpness effects of the inhibitor released from the DIR compound were assessed by monitoring the acutance of photographic layer 1. Higher acutance values indicate greater sharpness in the processed film.

The interimage effects of the inhibitor released from the DIR compound were assessed by monitoring the ratio of the gammas of photographic layer 1 (causer of interimage effect) and photographic layer 2 (receiver of interimage effect). The larger the gamma ratio, the larger the interimage effect (the degree of color correction) in the film.

Table I shows the identity and quantity of the DIR compound coated (in mg/m$^2$), the gamma of photographic layer 1 (the causer layer), the acutance of photographic layer 1, and the degree of interimage effect (color correction) of photographic layer 1 onto photographic layer 2 (causer gamma/receiver gamma).

TABLE I

| Coating Number | DIR COMPOUND No | DIR COMPOUND mg/m$^2$ | Gamma "causer" | CMT16mm[a] | Gamma "causer" / Gamma "receiver" |
|---|---|---|---|---|---|
| 1 (Control) | none | — | 1.70 | 92.2 | 1.14 |
| 2 (Comparative) | A | 36 | 0.57 | 96.2 | 0.77 |
| 3 (Comparative) | B | 38 | 0.61 | 96.2 | 0.52 |
| 4 (Comparative) | C | 39 | 0.47 | 95.2 | 0.41 |
| 5 (Inventive) | D-1 | 38 | 0.44 | 97.4 | 0.55 |
| 6 (Comparative) | D | 68 | 0.57 | 99.9 | 1.41 |
| 7 (Comparative) | E | 70 | 0.59 | 98.4 | 0.83 |
| 8 (Inventive) | D-2 | 58 | 0.55 | 100.5 | 1.04 |

[a]CMT 16mm acutance emphasizes spatial frequencies ranging from 15 to 80 cycle per mm in the film plane. Larger values of acutance indicate a sharper image.

The photographic data listed in Table I show that photographic elements using DIR Compounds D-1 and D-2 of this invention (Coating Nos. #5 and #8) exhibit the desired combination of low interimage effects (low GAMMA "causer"/GAMMA "receiver" values) and high acutance relative to use of compounds known in the art (Coating NOs. #2–4 and 6–7).

Comparative DIR Compound A (Compound No. 16 in U.S. Pat. No. 3,227,554):

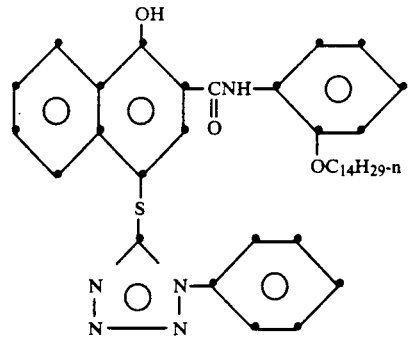

Comparative DIR Compound B (Compound Falling within U.S. Pat. No. 3,227,554):

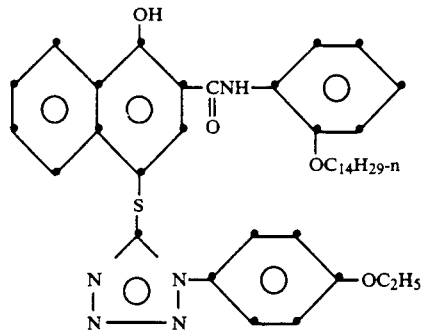

Comparative DIR Compound C (Compound 15 in Belgian Patent 789,595):

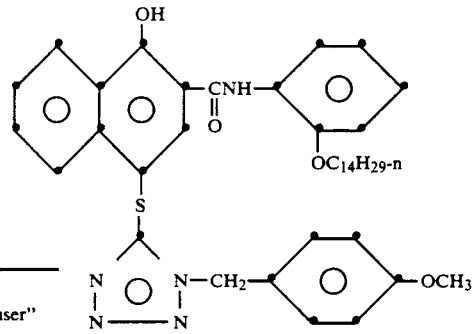

Comparative Compound D (Compound No. 4 of U.S. Pat. No. 4,248,962):

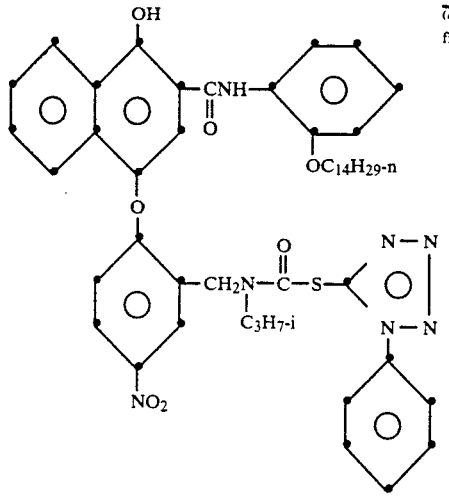

Comparative Compound E (Compound No. 8 of U.S. Pat. No. 4,248,962):

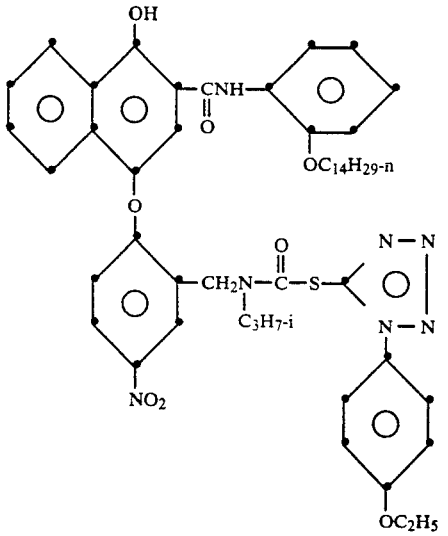

EXAMPLE 2

Three additional photographic elements (Coatings 9–11 of Table II) were prepared in the manner described in Example 1. These coatings were exposed as described in Example 1 and developed using the color process described in the British Journal of Photography Annual of 1988 pp. 196–198.

TABLE II

| Coating Number | DIR COMPOUND No | DIR COMPOUND mg/m² | Gamma "causer" | 35 sys[a] AMT | Gamma "causer" / Gamma "receiver" |
|---|---|---|---|---|---|
| 9 (Control) | none | none | 1.80 | 92.7 | 1.29 |
| 10 (Comparative) | F | 299 | 1.52 | 92.4 | 1.21 |
| 11 (Invention) | D-3 | 310 | 1.20 | 93.0 | 1.05 |

[a]35 sys AMT acutance emphasizes spatial frequencies ranging from 2.5 to 15 cycles per mm in the film plane. A larger acutance value indicates a sharper image.

The photographic data listed in Table II show that the photographic element using DIR Compound D-3 of this invention (Coating No. #11) exhibits the desired combination of lower interimage effects (low gamma "causer"/gamma "receiver" value) and high acutance relative to a DIR known in the art (Coating No. 10).

Comparative DIR Compound F (Compound falling within U.S. Pat. No. 4,248,962)

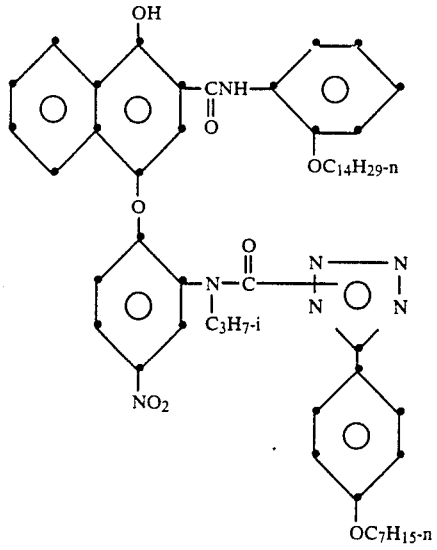

EXAMPLE 3

Three additional photographic elements (Coating Nos. 12–14 of Table III) were prepared in a manner similar to that described in Example 1 except that different dye-forming couplers were used. In this Example, photographic layer 1 incorporated IC-2 at 1300 mg/m² and photographic layer 2 incorporated IC-3 at 650 mg/m². These elements were exposed and processed as described in Example 1.

TABLE III

| Coating Number | DIR COMPOUND No | DIR COMPOUND mg/m² | Gamma "causer" | Disc sys[a] AMT | Gamma "causer" / Gamma "receiver" |
|---|---|---|---|---|---|
| 12 (Control) | none | — | 1.46 | 81.0 | 0.81 |
| 13 (Comparative) | G | 89 | 1.54 | 85.2 | 1.02 |
| 14 (Inventive) | D-104 | 93 | 1.05 | 87.0 | 0.94 |

[a]DISC sys acutance emphasizes spatial frequencies ranging from 2.5 to 30 cycles per mm in the film plane. Larger acutance values indicate a sharper image.

The photographic data listed in Table III show that the photographic element using DIR Compound D-104 of this invention (Coating No. 14) exhibits the desired combination of lower interimage effects (a low gamma c/gamma r value) and high acutance relative to a DIR compound known in the art (Coating No. 13). The only difference between the structures of DIR Compound G and DIR Compound D-104 is that in the latter a —S— thioether group replaces one carbon of the inhibitor's alkoxy substituent.

Comparative DIR Compound G

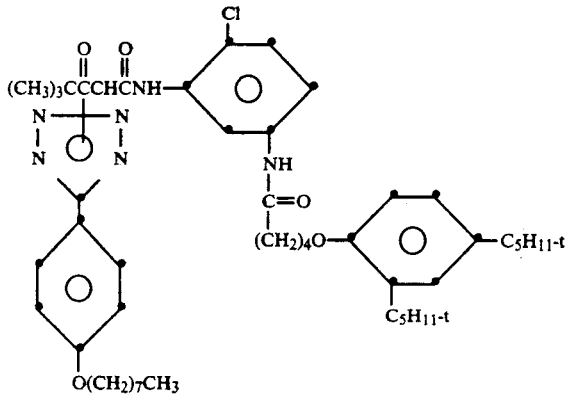

EXAMPLE 4

Inhibitor strength from partition coefficients

One advantage offered by compounds of the invention is that they provide inhibitor moieties having a combination of characteristics that afford improved color photographic results. Such improved results include the enhanced ability to inhibit silver development and reduce gamma. We have found that within each inhibitor class the logarithm of the partition coefficient (Log P) is a good measure of the strength of the inhibitor and its mobility to provide interimage effects. This is described more fully in R. P. Szajewski, et al., page 425 of "Progress in Basic Principles of Imaging Systems", F. Granzer and E. Moisar, eds. Vieweg & Sohn, Braunschweig, 1987.

Log P is the logarithm of the partition coefficient of a species between a standard organic phase, usually octanol, and an aqueous phase, usually water. The color photographic element is a polyphasic system, and a photographic inhibitor released in such a system can partition between these various phases. Log P can serve as a measure of this partitioning, and can be correlated to desirable inhibitor properties such as inhibition strength and interimage effects.

The Log P values reported herein are, unless otherwise indicated, calculated using the additive fragment techniques of C. Hansch and A. Leo as described in "Substituent Constants for Correlation Analysis in Chemistry and Biology:, Wiley, N.Y., 1979, using the computer program "MedChem", version 3.53, Medicinal Chemistry Project, Pomona College, Claremont, Calif. (1984). Where measured values of Log P are provided, they are measured by the techniques cited in A. Leo, C. Hansch, and D. Elkins, Chem. Rev., 71:525 (1971); see, for example, R. Livingston, "Physico Chemical Experiments:, third edition, Macmillan, N.Y., 1957, pp. 217 ff. Briefly, the material to be evaluated is dissolved in octanol. An equal volume of water or aqueous buffer of appropriate pH is added and the vessel shaken vigorously for 2 minutes. The mixture is centrifuged, and aliquots taken from both layers. The aliquots are analyzed by hplc (liquid chromatography) by comparison to samples of known concentration, and Log P calculated from the log of the ratio of the amount in the octanol phase to the amount in the aqueous phase.

Development inhibitors are generally released imagewise from an incorporated DIR compound during processing of the exposed photographic element. To evaluate the intrinsic inhibition strength of such inhibitors, independent of DIR release, an imbibition test is used. This involves imbibing an exposed film strip with a solution containing a given concentration of the free inhibitor to be tested. Nitrogen burst agitation of the imbibing solution improves the repeatability and effectiveness of inhibitor incorporation. The measured strength obtained by this test serves as an important guide in selecting inhibitors for desired photographic acutance improvements.

Film samples for imbibition testing of inhibitors were prepared having the following schematic layer structure and using a silver bromoiodide emulsion containing 6.4 mole % iodide (numerical values denote coating coverages in mg/m$^2$ and the silver halide values are for equivalent weights of silver):

| | |
|---|---|
| Overcoat: | Gelatin - 2691; Bis(vinylsulfonylmethyl) ether hardener at 1.75% by weight of total gelatin |
| Cyan Layer: | Gelatin - 2691; Green-sensitized AgBrI 1615; Cyan dye forming coupler (IC-1) 753 |
| Film Support: | Poly(ethylene terephthalate) |

Film strips cut from this coated element were exposed through a graduated density test object and a Kodak Wratten 99 (green) filter. Before development a strip was immersed at 38° C. under nitrogen agitation in each of the separate prebaths containing a test inhibitor at $5\times10^{-5}$M concentration in a pH 10 carbonate buffer plus 0.1% dimethylformamide. As controls, each test set included a check strip which was immersed in a prebath containing no inhibitor and strips immersed in prebaths containing the comparison inhibitors phenylmercaptotetrazole (CI-1) and ethylmercaptotetrazole (CI-2). Photographic processing was carried out at 38° C. in the following steps:

| | |
|---|---|
| Inhibitor prebath | 2 min |
| Developer(1) | 2.75 min |
| Stop | 2 min |
| Wash | 2 min |
| Bleach | 2 min |
| Wash | 2 min |
| Fix | 2 min |
| Wash | 2 min |

(1)Same developer as employed in Example I.

Red light densitometric curves were plotted for each strip and an exposure step at which the no-inhibitor check showed a density close to 1.0 above fog was selected. The density of each test strip at this same exposure was noted and the inhibition strength number (I.S. No.) calculated using the equation:

$$\frac{(\text{Density of check} - \text{density of test})}{\text{Density of check}} \times 100$$

Larger I.S. numbers for given inhibitors indicate stronger inhibition resulting in less dye density formed.

Table IV lists these C.I. numbers, as well as calculated log P values, for a number of inhibitors released by compounds of the invention and for comparison inhibitors CI-1 through CI-8. It can be seen that, at equivalent partition coefficient (Log P) values, the inhibitors useful in the invention show higher inhibition strength than the controls. Alternatively, at approximately equal inhibition strength, inhibitors of the invention have lower partition coefficients.

TABLE IV

Inhibitor Inhibition Strength vs Inhibitor Partition Coefficient

| Inhibitor | Calcd. Log P | Inhibition Strength No. |
|---|---|---|
| CI-3 (Comparative) | 4.71 | 18 |
| CI-4 (Comparative) | 5.15 | 43 |
| I-5 (Invention) | 5.06 | 95 |
| I-21 (Invention) | 4.86 | 95 |
| I-22 (Invention) | 4.86 | 94 |
| I-51 (Invention) | 4.86 | 83 |
| I-23 (Invention) | 4.33 | 77 |
| I-134 (Invention) | 3.83 | 77 |
| I-24 (Invention) | 2.74 | 20 |
| CI-5 (Comparative) | 5.44 | 52 |
| I-37 (Invention) | 3.46 | 66 |
| CI-6 (Comparative) | 4.49 | 16 |
| I-26 (Invention) | 4.64 | 67 |
| I-136 (Invention) | 4.49 | 84 |
| CI-7 (Comparative) | 3.32 | 40 |
| CI-8 (Comparative) | 2.38 | 35 |
| I-137 (Invention) | 3.36 | 86 |
| I-138 (Invention) | 3.19 | 69 |
| I-139 (Invention) | 2.48 | 88 |
| CI-1 (Comparative) | 1.49 | 80 |
| CI-2 (Comparative) | 0.23 | 15 |

Comparative Inhibitor Compounds:

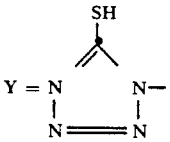

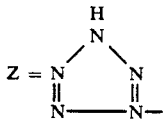

Y—$C_6H_5$ CI-1
Y—$C_2H_5$ CI-2
Z—$C_8H_{17}$-n CI-3
Z—$SC_9H_{19}$-n CI-4
Z—$N(C_6H_{13}$-n$)_2$ CI-5

CI-6

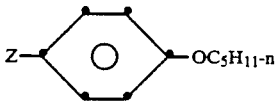

CI-7

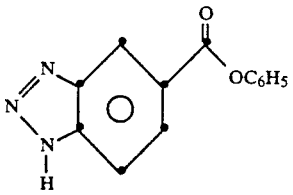

-continued

CI-8

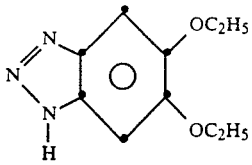

EXAMPLE 5

Four additional photographic elements (a control coating 15 and test coatings (16–18) were prepared having the following schematic layer structure and using silver bromoiodide emulsions containing 6.4 mole % iodide (numerical values denote coating coverages in mg/m$^2$ and the silver halide values are for equivalent weights of silver):

| | |
|---|---|
| Overcoat: | Gelatin - 5382; Bis(Vinylsulfonylmethyl) ether hardener at 2% by weight of total gelatin |
| Layer 1: (causer) | Gelatin - 2691; Green-sensitized AgBrI - 1615; Yellow dye forming coupler (IC-4) - 1163; DIR Compound (indicated in Table V) - 215 |
| Interlayer: | Gelatin - 861; 2,5-didodecylhydroquinone - 113 |
| Layer 2: (receiver) | Gelatin - 2423; Red-sensitized AgBrI - 1604; Magenta dye forming Coupler (IC-3) - 719 |
| Film Support: | Gelatin - 2443; Antihalation gray silver - 323 |

IC-4

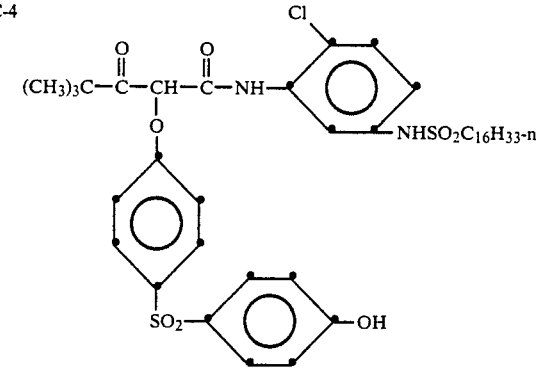

Comparative DIR Compound H

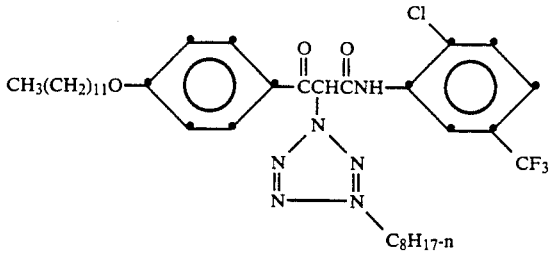

Film strips were exposed through a graduated-density test object and a Kodak Wratten 12 (minus blue) filter and then processed as in Example 1. Table V shows the resulting "causer" gamma Gc value as well as I.S. No. and Log P values drawn from Table IV.

TABLE V

| Coating No. | DIR No. | Inh. No. | I.S. No. | Log P | Gc |
|---|---|---|---|---|---|
| 15 (control) | — | — | — | — | 2.69 |
| 16 (comparison) | H | CI-3 | 18 | 4.71 | 2.89 |
| 17 (invention) | D-102 | I-23 | 77 | 4.33 | 1.72 |

It can be seen from Table V that comparison Compound H, which releases a tetrazole inhibitor bearing an octyl non thioether substituent, is ineffective in suppressing "causer" gamma. However, significantly more gamma suppression by development inhibition is seen for DIR Compound D-102 of the invention, which releases a similar inhibitor but bearing one thioether group in the alkyl substituent on the inhibitor moiety. The higher I.S. numbers and lower Log P values for the inhibitors useful in the invention correlate with their improved performance versus the comparison inhibitor released from the same parent coupler.

The invention has been described in detail with particular reference to preferred embodiments thereof, but it will be understood that variations and modifications can be effected within the spirit and scope of the invention.

We claim:

1. A photographic recording material comprising a support having thereon at least two light sensitive silver halide emulsion layers and a compound capable of releasing a development inhibitor upon exposure and process, wherein the compound has the structural formula:

$$CAR—(TIME)_n—INH—Q$$

wherein:

CAR is a carrier moiety from which $(TIME)_n$—INH—Q is released during development;

TIME is a timing group;

INH—Q together constitute a development inhibitor moiety which is an oxazole, thiazole, diazole, oxadiazole, oxathiazole, thiatriazole, benzotriazole, tetrazole, benzimidazole, indazole, isoindazole, mercaptotetrazole, selenotetrazole, mercaptothiazole, selenobenzothiazole, mercaptobenzoxazole, selenobenzoxazole, mercaptobenzimidazole, selenobenzimidazole, benzodiazole, mercaptooxadiazole, or benzisodiazole with the proviso that INH does not comprise a monocyclic triazole moiety;

Q comprises from 1 to 4 thioether moieties, in each of which the sulfur atom is directly bonded to a saturated carbon atom but is not directly bonded to an INH heterocyclic ring; and n is 0, 1, or 2.

2. The recording material according to claim 1 wherein the thioether moieties comprise an alkyl, alkylene, aryl, arylene, alkoxy, aryloxy, alkylthio, arylthio, alkylamino, arylamino, carbalkoxy or a heterocyclic group.

3. The recording material according to claim 1 wherein a thioether sulfur atom is bonded directly to $—(CH_2)_m—$, where m is 1 to 12,

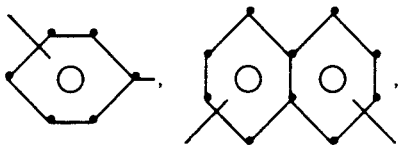

$—CH_3$, $—CH_2CH_3$, $—C_3H_7$, $—C_4H_9$, $—C_4H_9—t$, $—C_5H_{11}$, cyclopentyl, cyclohexyl or phenyl.

4. The recording material according to claim 1 wherein INH—Q comprises a 1,2,3,4-tetrazole moiety having the structure:

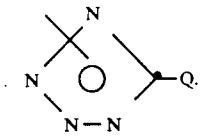

5. The recording material according to claim 1 wherein INH—Q comprises a 5-mercapto-1,2,3,4-tetrazole moiety having the structure:

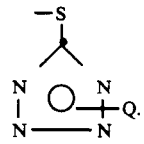

6. The recording material according to claim 1 wherein INH—Q comprises a benzotriazole moiety having the structure:

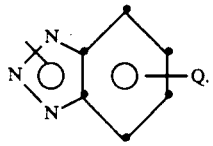

7. The recording material of claim 1 wherein CAR is a coupler moiety.

8. The recording material of claim 7 wherein the coupler moiety is ballasted.

9. The recording material of claim 7 wherein $(TIME)_n$—INH—Q is bonded to a coupling position of the coupler moiety.

10. The recording material of claim 1 wherein the compound capable of releasing a development inhibitor has the structural formula:

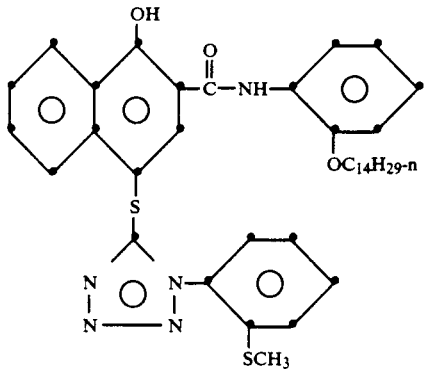

11. The recording material of claim 1 wherein the compound capable of releasing a development inhibitor has the structural formula:

12. The recording material of claim 1 wherein the compound capable of releasing a development inhibitor has the structural formula:

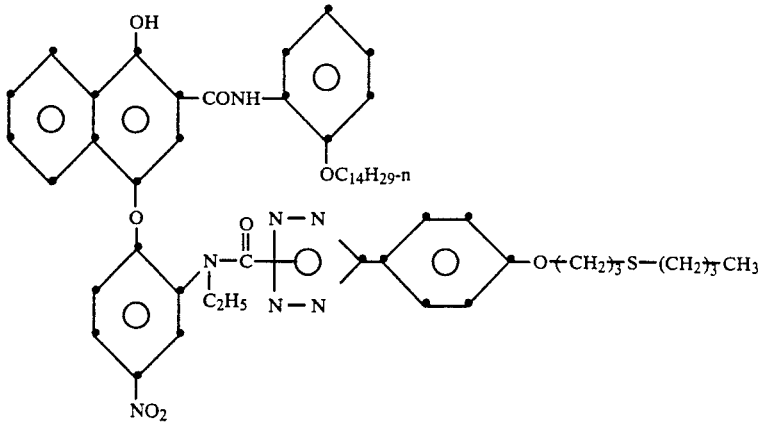

13. The recording material of claim 1 wherein the compound capable of releasing a development inhibitor has the structural formula:

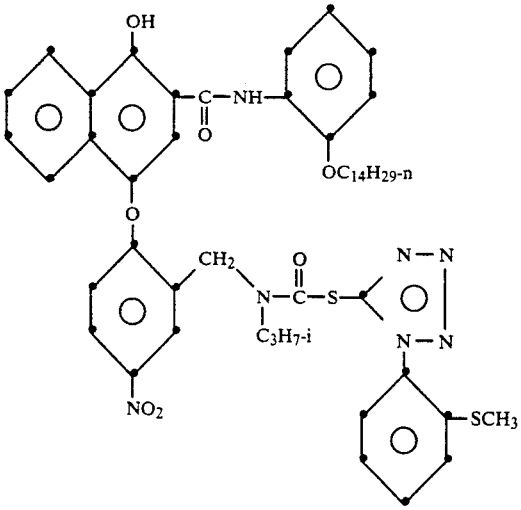

14. The recording material of claim 1 wherein the compound capable of releasing a development inhibitor has the structural formula:

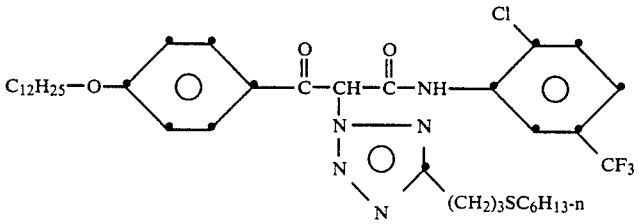

15. The recording material of claim 1 wherein the compound capable of releasing a development inhibitor has the structural formula:

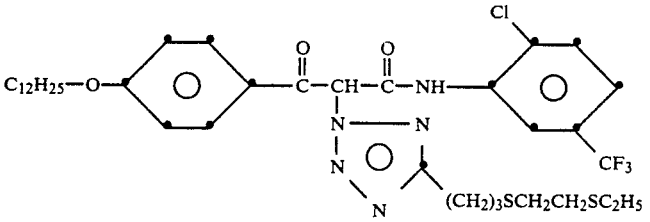

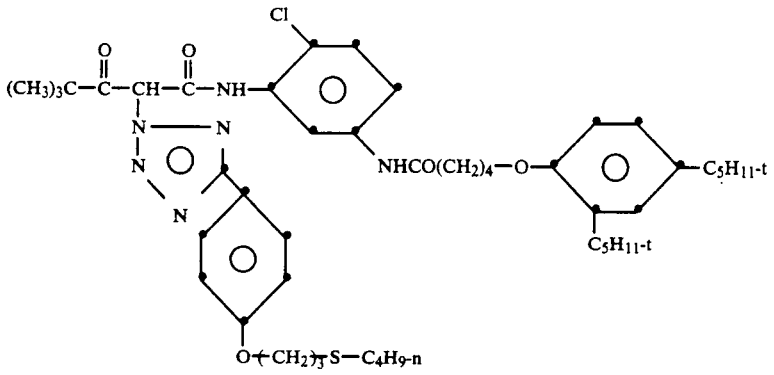
Cl
O
O
(CH3)3C—C—CH—C—NH
N
N
N
N
NHCO(CH2)4—O
C5H11-t
C5H11-t
O(CH2)3S—C4H9-n